US009777520B2

(12) United States Patent
Volin

(10) Patent No.: US 9,777,520 B2
(45) Date of Patent: Oct. 3, 2017

(54) UNIQUE ANTI-WARPING ANTI-SAGGING INTERLOCKING GATE, HAVING ANTI-WARPING ANTI-SAGGING INTERLOCKING TRIPLE-U-SHAPED-CLAMP BRACKETS, ANTI-WARPING ANTI-SAGGING INTERLOCKING L-SHAPED HINGES, AND INTERLOCKING TUBE NUTS

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 0 days.

(21) Appl. No.: 15/191,501

(22) Filed: Jun. 23, 2016

(65) Prior Publication Data

US 2016/0376822 A1 Dec. 29, 2016

Related U.S. Application Data

(60) Provisional application No. 62/185,262, filed on Jun. 26, 2015.

(51) Int. Cl.

| | |
|---|---|
| ***E05F 7/06*** | (2006.01) |
| ***E05D 5/06*** | (2006.01) |
| ***E06B 11/02*** | (2006.01) |
| ***E05D 11/00*** | (2006.01) |
| ***E05D 7/00*** | (2006.01) |

(52) U.S. Cl.

CPC ..... *E05D 5/06* (2013.01); *E05D 7/00* (2013.01); *E05D 11/00* (2013.01); *E06B 11/022* (2013.01)

(58) Field of Classification Search

CPC .. E05D 5/06; E05D 7/00; E05D 11/00; E05D 11/022

USPC ..... 49/396; 256/73

See application file for complete search history.

(56) References Cited

U.S. PATENT DOCUMENTS

| | | | | |
|---|---|---|---|---|
| 699,727 | A * | 5/1902 | Upton et al. | E05D 7/0407 16/236 |
| 1,338,209 | A | 4/1920 | Bruber | |
| 1,344,820 | A | 6/1920 | Reh | |
| 1,469,425 | A | 10/1923 | Mehanna | |
| 1,722,365 | A | 7/1929 | Beach | |
| 1,841,898 | A | 1/1932 | Lehman | |
| 2,039,125 | A | 4/1936 | Stuart | |
| 2,231,882 | A | 2/1941 | Bryant | |
| 2,277,176 | A | 3/1942 | Wanger | |
| 2,569,836 | A | 10/1951 | Tilbury | |

(Continued)

*Primary Examiner* — Jerry Redman

(57) ABSTRACT

A unique anti-warping anti-sagging interlocking gate comprises: multiple triple-U-shaped-clamp bracket systems having front and rear plates and bracket tube nuts, multiple anti-warping anti-sagging interlocking-tube-nut hinge systems having crisscross 90-degree hinge tube nuts, multiple struts, a truss having cable ends and a cable clamp, and a truss-cable-clamp-hiding tunnel system. The front and rear plates and bracket tube nuts are for uniquely securing the triple-U-shaped-clamp bracket systems to the struts to prevent the interlocking gate from warping and sagging. The crisscross 90-degree hinge tube nuts are for uniquely interlocking the hinge systems to a fence post in two 90-degree interlocking directions and in five different crisscross interlocking elevations. The truss-cable-clamp-hiding tunnel system is for uniquely hiding the cable ends and a cable clamp inside one of the struts and under one of the triple-U-shaped-clamp bracket systems.

20 Claims, 26 Drawing Sheets

(56) References Cited

U.S. PATENT DOCUMENTS 2,602,954 A 11/1954 Steward
2,693,043 A 11/1954 Leake
2,709,313 A * 5/1955 Nead ..... E06B 11/04 16/223
2,794,276 A 6/1957 Van Der Lely et al.
2,810,220 A 10/1957 Koch
2,837,760 A 6/1958 Ware
2,970,799 A 2/1961 Pinson
3,101,929 A 8/1963 Dvore
3,107,390 A 10/1963 Shelton
3,727,266 A 4/1973 Ashworth
3,751,084 A 8/1973 Lening
3,751,759 A 8/1973 Duncan
3,988,860 A * 11/1976 Nevarez ..... E05F 15/627 49/327
4,010,504 A 3/1977 Griffin
4,047,332 A 9/1977 Benoit
4,079,481 A 3/1978 Cacicedo
4,468,888 A * 9/1984 Harris ..... E06B 11/04 49/396
5,042,198 A 8/1991 Privratsky
5,282,336 A 2/1994 Tucker
5,628,149 A * 5/1997 Kraczek ..... E04F 21/0007 49/396
D410,835 S 6/1999 Cosgrove
5,921,027 A 7/1999 Siebenahler
6,464,209 B2 10/2002 Meis
D479,116 S 9/2003 Gross
6,681,525 B1 1/2004 Dudley
6,752,438 B2 6/2004 DeSouza
6,896,244 B2 * 5/2005 Boroviak ..... E05D 5/06 256/24
7,032,892 B2 4/2006 Boroviak
7,249,755 B2 7/2007 Boroviak
7,665,187 B1 2/2010 Elowsky
7,895,713 B2 3/2011 Williams, Jr.
7,992,842 B2 8/2011 Boroviak
8,210,504 B1 * 7/2012 Skornickel ..... E04H 17/1421 256/65.01
8,443,490 B2 5/2013 Forrest
8,556,235 B2 10/2013 Boroviak
8,656,557 B2 2/2014 Stull
8,739,367 B2 6/2014 Park
9,121,207 B2 9/2015 Stuart
9,121,222 B2 9/2015 Walker
9,151,097 B1 10/2015 Elowsky
9,359,787 B2 6/2016 Callahan
2002/0069587 A1 * 6/2002 Bass ..... E06B 11/02 49/396
2004/0067101 A1 4/2004 Gross
2004/0189019 A1 9/2004 Kooistra
2005/0063770 A1 3/2005 Gross
2006/0231821 A1 10/2006 Gavin
2012/0217460 A1 * 8/2012 Bugh ..... E06B 11/02 256/73
2016/0108668 A1 * 4/2016 Volin ..... E06B 7/14 256/73

* cited by examiner

UNIQUE ANTI-WARPING ANTI-SAGGING INTERLOCKING GATE, HAVING ANTI-WARPING ANTI-SAGGING INTERLOCKING TRIPLE-U-SHAPED-CLAMP BRACKETS, ANTI-WARPING ANTI-SAGGING INTERLOCKING L-SHAPED HINGES, AND INTERLOCKING TUBE NUTS

1. FIELD OF THE INVENTION

The present invention relates to a bracket fence gate for preventing the gate from warping and sagging. Particularly, the present invention relates to a unique anti-warping anti-sagging interlocking gate, which has:

a) Multiple anti-warping anti-sagging interlocking triple-U-shaped-clamp bracket systems,
b) Multiple anti-warping anti-sagging interlocking L-shaped-plate hinge systems, and
c) Multiple anti-warping anti-sagging interlocking-tube-nut systems.

2. DESCRIPTION OF THE PRIOR ART

A number of bracket fence gates have been introduced.

U.S. Pat. No. 1,338,209, issued 1920 Apr. 27, to V. G. Bruber;
U.S. Pat. No. 1,344,820, issued 1920 Jun. 29, to M. Reh;
U.S. Pat. No. 1,469,425, issued 1923 Oct. 2, to W. E. Mehanna;
U.S. Pat. No. 1,722,365, issued 1929 Jul. 30, to F. H, Beach;
U.S. Pat. No. 1,841,898, issued 1932 Jan. 19, to L. H. Lehman;
U.S. Pat. No. 2,039,125, issued 1936 Apr. 28, to D. R, Stuart;
U.S. Pat. No. 2,231,882, issued 1941 Feb. 18, to H. Bryant;
U.S. Pat. No. 2,277,176, issued 1942 Mar. 24, to R. S. Wanger;
U.S. Pat. No. 2,569,836, issued 1951 Oct. 2, to L. C. Tilbury;
U.S. Pat. No. 2,602,954, issued 1952 Jul. 15, to H. W. Steward;
U.S. Pat. No. 2,693,043, issued 1954 Nov. 2, to A. G. Leake;
U.S. Pat. No. 2,794,276, issued 1957 Jun. 4, to C. Van Der Lely Etal;
U.S. Pat. No. 2,810,220, issued 1957 Oct. 22, to W. H. Koch;
U.S. Pat. No. 2,837,760, issued 1958 Jun. 10, to D. V. Ware;
U.S. Pat. No. 2,970,799, issued 1961 Feb. 7, to A. Pinson;
U.S. Pat. No. 3,101,929, issued 1963 Aug. 27, to C. Dvore;
U.S. Pat. No. 3,107,390, issued 1963 Oct. 22, to D. L. Shelton;
U.S. Pat. No. 3,727,266, issued 1973 Apr. 17, to Ashworth James E;
U.S. Pat. No. 3,751,084, issued 1973 Aug. 7, to Lening George O;
U.S. Pat. No. 3,751,759, issued 1973 Aug. 14, to Duncan Alan W;
U.S. Pat. No. 4,010,504, issued 1977 Mar. 8, to Griffin Ronald G.;
U.S. Pat. No. 4,047,332, issued 1977 Sep. 13, to Benoit Orient;
U.S. Pat. No. 4,079,481, issued 1978 Mar. 21, to Cacicedo Paulino A;
U.S. Pat. No. 5,042,198, issued 1991 Aug. 27, to Privratsky Steven M;
U.S. Pat. No. 5,282,336, issued 1994 Feb. 1, to Tucker Walt;
U.S. Pat. No. 5,921,027, issued 1999 Jul. 13, to Siebenahler Lyle M;

U.S. Pat. No. 6,464,209, issued 2002 Oct. 15, to Meis William J, Yard Robert W;
U.S. Pat. No. 6,681,525, issued 2004 Jan. 27, to Dudley David Edmond;
U.S. Pat. No. 6,752,438, issued 2004 Jun. 22, to DeSouza Joseph;
U.S. Pat. No. 6,896,244, issued 200-05-24, to Boroviak Richard;
U.S. Pat. No. 7,032,892, issued 2006 Apr. 25, to Boroviak Richard;
U.S. Pat. No. 7,249,755, issued 2007 Jul. 31, to Boroviak Richard;
U.S. Pat. No. 7,665,187, issued 2010 Feb. 23, to Elowsky James E;
U.S. Pat. No. 7,895,713, issued 2011 Mar. 1, to Williams, Jr. Peter E;
U.S. Pat. No. 7,992,842, issued 2011 Aug. 9, to Boroviak Richard;
U.S. Pat. No. 8,210,504, issued 2012 Jul. 3, to Skornickel; Anthony J;
U.S. Pat. No. 8,443,490, issued 2013 May 21, to Forrest; Earl David, Graff; Andrew J;
U.S. Pat. No. 8,556,235, issued 2013 Oct. 15, to Boroviak Richard;
U.S. Pat. No. 8,656,557, issued 2014 Feb. 25, to Stull Edward J;
U.S. Pat. No. 8,739,367, issued 2014 Jun. 3, to Park Jang-Ho;
U.S. Pat. No. 9,121,207, issued 2015 Sep. 1, to Stuart Michael Christopher;
U.S. Pat. No. 9,121,222, issued 2015 Sep. 1, to Walker Simon;
U.S. Pat. No. 9,151,097, issued 2015 Oct. 6, to Elowsky James Eric;
U.S. Pat. No. 9,359,787, issued 2016 Jun. 7, to Callahan Thomas Patrick;
U.S. Pat. No. D410835, issued 1999 Jun. 8, to Cosgrove Barry;
U.S. Pat. No. D479116, issued 2003 Sep. 2, to Gross John A;
U.S. Patent No. 20040067101, issued 2004 Apr. 8, to Gross John;
U.S. Patent No. 20040189019, issued 2004 Sep. 30, to Kooistra Calvin;
U.S. Patent No. 20050063770, issued 2005 Mar. 24, to Gross John; and
U.S. Patent No. 20060231821, issued 2006 Oct. 19, to Gavin Troy disclose a variety of inventions related to bracket fence gates.

Disadvantages of the Prior Art

The prior art have failed to solve many problems associated with such bracket fence gates, as follows:

1) No prior art mention or disclose any bracket fence gates, having
truss-cable-clamp tunnel 223 (FIGS. 8A and 8B).
Therefore, the prior art of bracket fence gates
Can not hide hazardous messy truss cable clamp 214 and the hazardous messy ends of truss cable 213 in truss-cable-clamp tunnel 223 (FIGS. 8A and 8B) to prevent them from poking and cutting the fingers and hands of people to eliminate personal injuries.
2) No prior art mention or disclose any bracket fence gates, having
truss-cable-clamp tunnel 223 (FIGS. 8A and 8B).

Therefore, the prior art of bracket fence gates

Can not hide hazardous messy truss cable clamp 214 and the hazardous messy ends of truss cable 213 in truss-cable-clamp tunnel 223 (FIGS. 8A and 8B) to protect them from weather elements to prevent them from rusting to prolong their service life span.

3) No prior art mention or disclose any bracket fence gates, having truss-cable-clamp tunnel 223 (FIGS. 8A and 8B).

Therefore, the prior art of bracket fence gates

Can not hide hazardous messy truss cable clamp 214 and the hazardous messy ends of truss cable 213 in truss-cable-clamp tunnel 223 (FIGS. 8A and 8B) to make the unique anti-warping anti-sagging interlocking gate safer and to give the unique anti-warping anti-sagging interlocking gate a unique smooth, stylish, and modern look (free of hazardous messy truss cable clamp 214 and the hazardous messy ends of truss cable 213).

4) No prior art mention or disclose any bracket fence gates, having upper left horizontal-U-shaped-clamp tube nuts 105,
upper left vertical-U-shaped-clamp tube nuts 110,
lower left horizontal-U-shaped-clamp tube nuts 119, and
lower left vertical-U-shaped-clamp tube nuts 124 (FIGS. 3 and 4).

Therefore, the prior art of bracket fence gates

Can not have metallic screws 106, 111. 120, and 125 screwed through wooden struts into metallic tube nuts 105, 110, 119, and 124 (not just into wooden struts) (FIGS. 3 and 4) to prevent the unique anti-warping anti-sagging interlocking gate from getting rotten, warping, and sagging to prolong its service life span.

5) No prior art mention or disclose any bracket fence gates, having upper right horizontal-U-shaped-clamp tube nuts 132,
upper right vertical-U-shaped-clamp tube nuts 137,
lower right horizontal-U-shaped-clamp tube nuts 145, and
lower right vertical-U-shaped-clamp tube nuts 150 (FIGS. 3 and 4).

Therefore, the prior art of bracket fence gates

Can not have metallic screws 133, 138. 146, and 151 screwed through wooden struts into metallic tube nuts 132, 137, 145, and 150 (not just into wooden struts) (FIGS. 3 and 4) to prevent the unique anti-warping anti-sagging interlocking gate from getting rotten, warping, and sagging to prolong its service life span.

6) No prior art mention or disclose any bracket fence gates, having upper left middle-U-shaped-clamp front plate 112,
upper left middle-U-shaped-clamp rear plate 113,
lower left middle-U-shaped-clamp front plate 126, and
lower left middle-U-shaped-clamp rear plate 127 (FIGS. 6A and 6B).

Therefore, the prior art of bracket fence gates:

Can not reinforce and strengthen itself to prevent the unique anti-warping anti-sagging interlocking gate from getting rotten, warping, and sagging to prolong its service life span.

7) No prior art mention or disclose any bracket fence gates, having upper right middle-U-shaped-clamp front plate 139,
upper right middle-U-shaped-clamp rear plate 140,
lower right middle-U-shaped-clamp front plate 152, and
lower right middle-U-shaped-clamp rear plate 153 (FIGS. 6A and 6B).

Therefore, the prior art of bracket fence gates

Can not reinforce and strengthen itself to prevent the unique anti-warping anti-sagging interlocking gate from getting rotten, warping, and sagging to prolong its service life span.

8) No prior art mention or disclose any bracket fence gates, having upper L-shaped-hinge-plate front tube nuts 163,
upper L-shaped-hinge-plate side tube nuts 165,
lower L-shaped-hinge-plate front tube nuts 174, and
lower L-shaped-hinge-plate side tube nuts 176 (FIGS. 6H and 6I).

Therefore, the prior art of bracket fence gates

Can not secure (in two 90-degree directions, which are side-to-side and front-to-rear directions) upper and lower anti-warping anti-sagging interlocking-tube-nut hinge systems 155 and 166 (FIGS. 6H and 6I) to prevent the unique anti-warping anti-sagging interlocking gate from getting rotten, warping, and sagging to prolong its service life span.

9) No prior art mention or disclose any bracket fence gates, having upper L-shaped-hinge-plate front tube nuts 163,
upper L-shaped-hinge-plate side tube nuts 165,
lower L-shaped-hinge-plate front tube nuts 174, and
lower L-shaped-hinge-plate side tube nuts 176 (FIGS. 6A and 6H).

Therefore, the prior art of bracket fence gates

Can not secure (in five crisscross different elevations, which are side-to-side and front-to-rear elevations) upper and lower anti-warping anti-sagging interlocking-tube-nut hinge systems 155 and 166 (FIGS. 6A and 6H) to prevent the unique anti-warping anti-sagging interlocking gate from getting rotten, warping, and sagging to prolong its service life span.

Objects and Advantages of the Invention

The new invention substantially departs from the conventional concepts and designs of the prior art. In doing so, the new invention provides a unique anti-warping anti-sagging interlocking gate having many unique and significant features, functions, and advantages, which overcome all the disadvantages of the prior art, as follows:

1) It is an object of the new invention to provide a unique anti-warping anti-sagging interlocking gate, having truss-cable-clamp tunnel 223 (FIGS. 8A and 8B).

Therefore, the unique anti-warping anti-sagging interlocking gate:

Can hide hazardous messy truss cable clamp 214 and the hazardous messy ends of truss cable 213 in truss-cable-clamp tunnel 223 (FIGS. 8A and 8B) to prevent them from poking and cutting the fingers and hands of people to eliminate personal injuries.

2) It is another object of the new invention to provide a unique anti-warping anti-sagging interlocking gate, having truss-cable-clamp tunnel 223 (FIGS. 8A and 8B).

Therefore, the unique anti-warping anti-sagging interlocking gate:

Can hide hazardous messy truss cable clamp 214 and the hazardous messy ends of truss cable 213 in truss-cable-clamp tunnel 223 (FIGS. 8A and 8B) to protect them from weather elements to prevent them from rusting to prolong their service life span.

3) It is a further object of the new invention to provide a unique anti-warping anti-sagging interlocking gate, having
truss-cable-clamp tunnel 223 (FIGS. 8A and 8B).
Therefore, the unique anti-warping anti-sagging interlocking gate
Can hide hazardous messy truss cable clamp 214 and the hazardous messy ends of truss cable 213 in truss-cable-clamp tunnel 223 (FIGS. 8A and 8B) to make the unique anti-warping anti-sagging interlocking gate safer and to give the unique anti-warping anti-sagging interlocking gate a unique smooth, stylish, and modern look (free of hazardous messy truss cable clamp 214 and the hazardous messy ends of truss cable 213).

4) It is an even further object of the new invention to provide a unique anti-warping anti-sagging interlocking gate, having
upper left horizontal-U-shaped-clamp tube nuts 105,
upper left vertical-U-shaped-clamp tube nuts 110,
lower left horizontal-U-shaped-clamp tube nuts 119, and
lower left vertical-U-shaped-clamp tube nuts 124 (FIGS. 3 and 4).
Therefore, the unique anti-warping anti-sagging interlocking gate:
Can have metallic screws 106, 111. 120, and 125 screwed through wooden struts into metallic tube nuts 105, 110, 119, and 124 (not just into wooden struts) (FIGS. 3 and 4) to prevent the unique anti-warping anti-sagging interlocking gate from getting rotten, warping, and sagging to prolong its service life span.

5) It is another object of the new invention to provide a unique anti-warping anti-sagging interlocking gate, having
upper right horizontal-U-shaped-clamp tube nuts 132,
upper right vertical-U-shaped-clamp tube nuts 137,
lower right horizontal-U-shaped-clamp tube nuts 145, and
lower right vertical-U-shaped-clamp tube nuts 150 (FIGS. 3 and 4).
Therefore, the unique anti-warping anti-sagging interlocking gate:
Can have metallic screws 133, 138. 146, and 151 screwed through wooden struts into metallic tube nuts 132, 137, 145, and 150 (not just into wooden struts) (FIGS. 3 and 4) to prevent the unique anti-warping anti-sagging interlocking gate from warping and sagging to prolong its service life span.

6) It is yet another object of the new invention to provide a unique anti-warping anti-sagging interlocking gate, having
upper left middle-U-shaped-clamp front plate 112,
upper left middle-U-shaped-clamp rear plate 113,
lower left middle-U-shaped-clamp front plate 126, and
lower left middle-U-shaped-clamp rear plate 127 (FIGS. 6A and 6B).
Therefore, the unique anti-warping anti-sagging interlocking gate:
Can reinforce and strengthen itself to prevent the unique anti-warping anti-sagging interlocking gate from getting rotten, warping, and sagging to prolong its service life span.

7) It is still yet another object of the new invention to provide a unique anti-warping anti-sagging interlocking gate, having
upper right middle-U-shaped-clamp front plate 139,
upper right middle-U-shaped-clamp rear plate 140,
lower right middle-U-shaped-clamp front plate 152, and
lower right middle-U-shaped-clamp rear plate 153 (FIGS. 6A and 6B).
Therefore, the unique anti-warping anti-sagging interlocking gate:
Can reinforce and strengthen itself to prevent the unique anti-warping anti-sagging interlocking gate from getting rotten, warping, and sagging to prolong its service life span.

8) It is still yet an even further object of the new invention to provide a unique anti-warping anti-sagging interlocking gate, having
upper L-shaped-hinge-plate front tube nuts 163,
upper L-shaped-hinge-plate side tube nuts 165,
lower L-shaped-hinge-plate front tube nuts 174, and
lower L-shaped-hinge-plate side tube nuts 176 (FIGS. 6H and 6I).
Therefore, the unique anti-warping anti-sagging interlocking gate:
Can secure (in two 90-degree directions, which are side-to-side and front-to-rear directions) upper and lower anti-warping anti-sagging interlocking-tube-nut hinge systems 155 and 166 (FIGS. 6H and 6I) to prevent the unique anti-warping anti-sagging interlocking gate from getting rotten, warping, and sagging to prolong its service life span.

9) It is still yet an even further object of the new invention to provide a unique anti-warping anti-sagging interlocking gate, having
upper L-shaped-hinge-plate front tube nuts 163,
upper L-shaped-hinge-plate side tube nuts 165,
lower L-shaped-hinge-plate front tube nuts 174, and
lower L-shaped-hinge-plate side tube nuts 176 (FIGS. 6A and 6H).
Therefore, the unique anti-warping anti-sagging interlocking gate:
Can secure (in five crisscross different elevations, which are side-to-side and front-to-rear elevations) upper and lower anti-warping anti-sagging interlocking-tube-nut hinge systems 155 and 166 (FIGS. 6A and 6H) to prevent the unique anti-warping anti-sagging interlocking gate from getting rotten, warping, and sagging to prolong its service life span.

Other objects and advantages of the present invention will become apparent from a consideration of the accompanying drawings and ensuing description.

SUMMARY OF THE INVENTION

Figure 1:
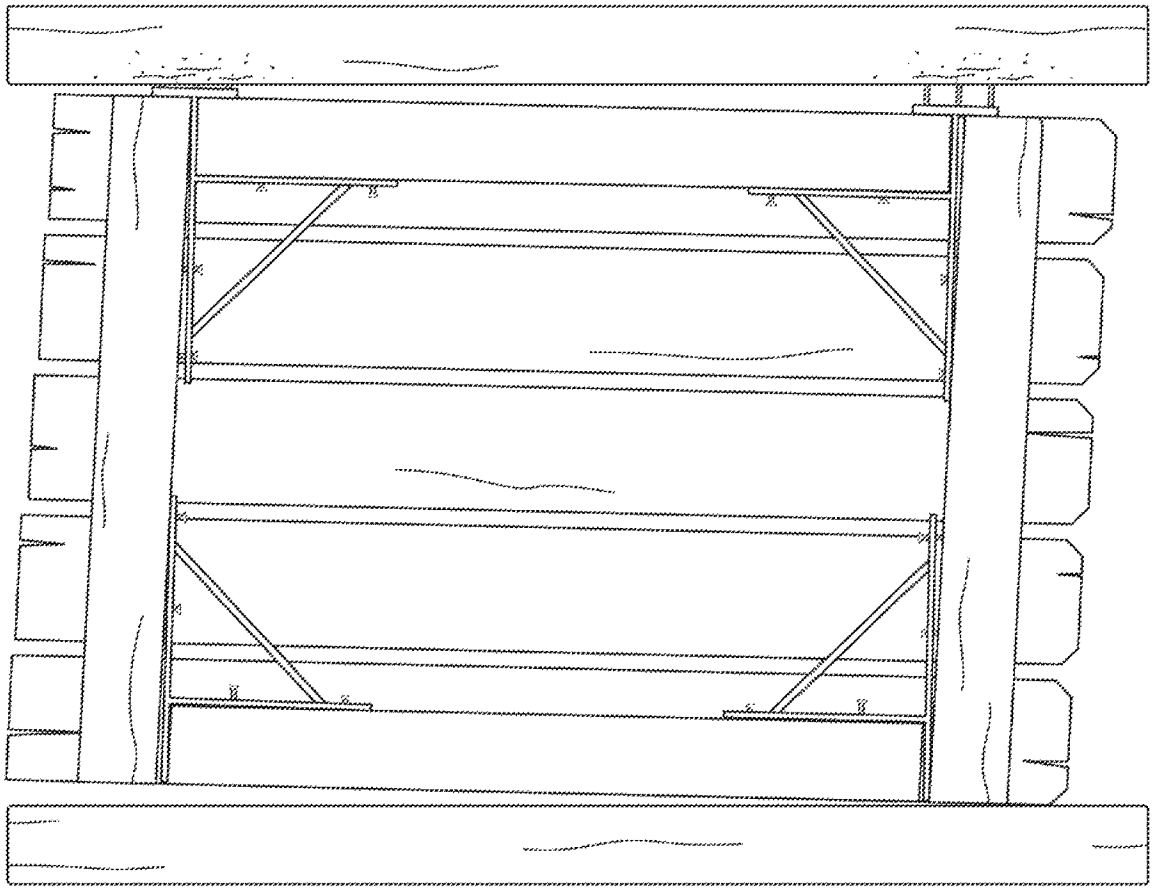
Fig. 1 (Prior Art)
FIGS. 1 (Prior art) and 2 (Prior art) illustrate the disadvantages of the prior art.
Figure 2:
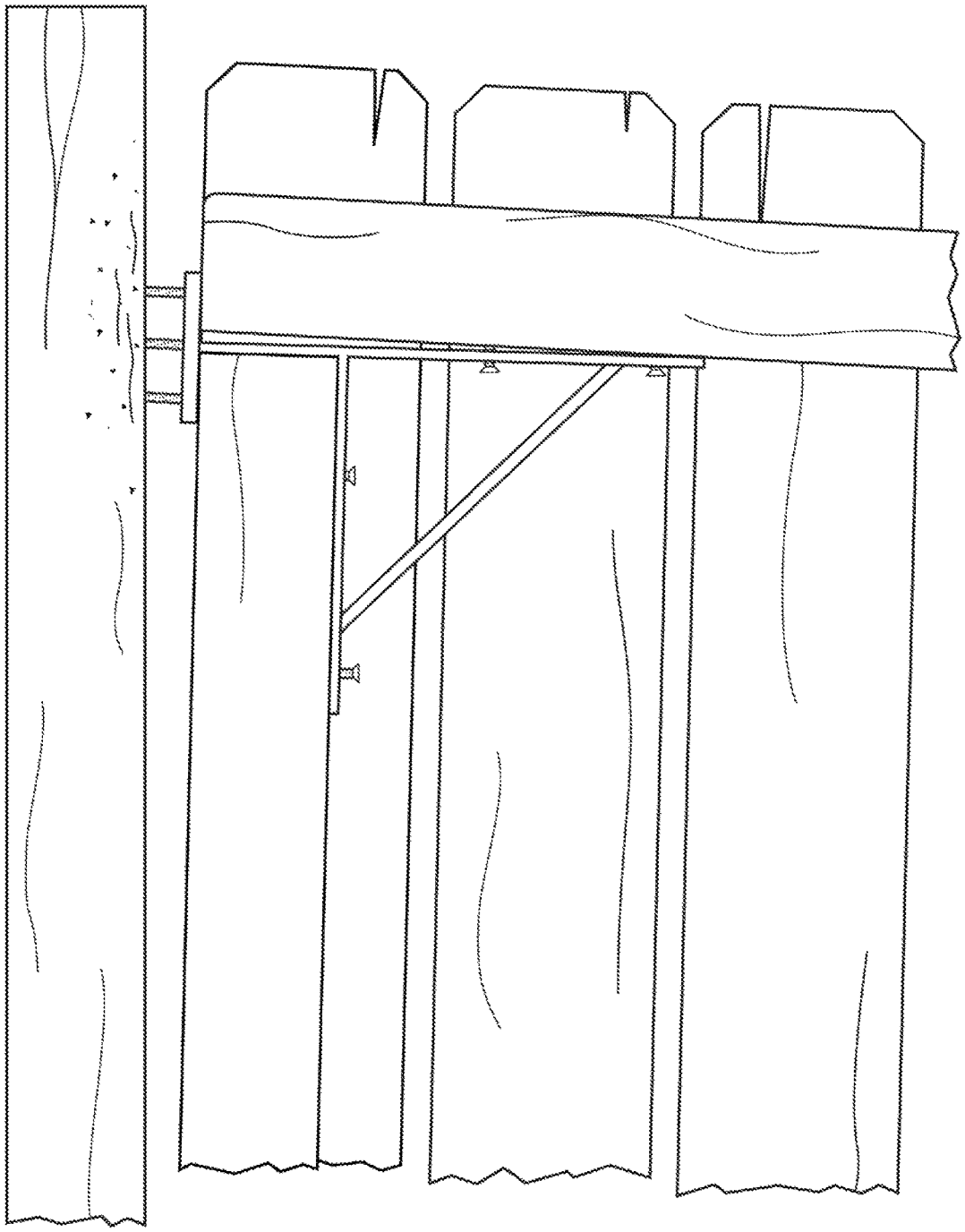
Fig. 2 (Prior Art)

A unique anti-warping anti-sagging interlocking gate comprises: multiple triple-U-shaped-clamp bracket systems having front and rear plates and bracket tube nuts, multiple anti-warping anti-sagging interlocking-tube-nut hinge systems having crisscross 90-degree hinge tube nuts, multiple struts, a truss having cable ends and a cable clamp, and a truss-cable-clamp-hiding tunnel system. The front and rear plates and bracket tube nuts are for uniquely securing the triple-U-shaped-clamp bracket systems to the struts to prevent the interlocking gate from warping and sagging. The crisscross 90-degree hinge tube nuts are for uniquely interlocking the hinge systems to a fence post in two 90-degree interlocking directions and in five different crisscross interlocking elevations. The truss-cable-clamp-hiding tunnel system is for uniquely hiding the cable ends and a cable clamp inside one of the struts and under one of the triple-U-shaped-clamp bracket systems.

DETAILED DESCRIPTION OF THE INVENTION

Component

Referring to FIGS. 3, 4, 5, 6A, 6B, 6C, 6D, 6E, 6F, 6G, 6H, 6I, 7A, 7B, 7C, 7D, and 7E, a unique anti-warping anti-sagging interlocking gate, having multiple anti-warping anti-sagging interlocking triple-U-shaped-clamp bracket systems, multiple anti-warping anti-sagging interlocking L-shaped-plate hinge systems, and multiple anti-warping anti-sagging interlocking-tube-nut systems, comprises:

1) Upper left anti-warping anti-sagging triple-U-shaped-clamp bracket system 101, comprising:
2) Upper left horizontal U-shaped clamp 102,
3) Upper left horizontal-U-shaped-clamp screw openings 103,
4) Upper left horizontal-U-shaped-clamp screws 104,
5) Upper left horizontal-U-shaped-clamp tube nuts 105,
6) Upper left horizontal-U-shaped-clamp pointed-tip screws 106,
7) Upper left vertical U-shaped clamp 107,
8) Upper left vertical-U-shaped-clamp screw openings 108,
9) Upper left vertical-U-shaped-clamp screws 109,
10) Upper left vertical-U-shaped-clamp tube nuts 110,
11) Upper left vertical-U-shaped-clamp pointed-tip screws 111,
12) Upper left middle-U-shaped-clamp front plate 112,
13) Upper left middle-U-shaped-clamp rear plate 113,
14) Upper left truss ring 114;
15) Lower left anti-warping anti-sagging triple-U-shaped-clamp bracket system 115, comprising:
16) Lower left horizontal U-shaped clamp 116,
17) Lower left horizontal-U-shaped-clamp screw openings 117,
18) Lower left horizontal-U-shaped-clamp screws 118,
19) Lower left horizontal-U-shaped-clamp tube nuts 119,
20) Lower left horizontal-U-shaped-clamp pointed-tip screws 120,
21) Lower left vertical U-shaped clamp 121,
22) Lower left vertical-U-shaped-clamp screw openings 122,
23) Lower left vertical-U-shaped-clamp screws 123,
24) Lower left vertical-U-shaped-clamp tube nuts 124,
25) Lower left vertical-U-shaped-clamp pointed-tip screws 125,
26) Lower left middle-U-shaped-clamp front plate 126,
27) Lower left middle-U-shaped-clamp rear plate 127;

28) Upper right anti-warping anti-sagging triple-U-shaped-clamp bracket system 128, comprising:
29) Upper right horizontal U-shaped clamp 129,
30) Upper right horizontal-U-shaped-clamp screw openings 130,
31) Upper right horizontal-U-shaped-clamp screws 131,
32) Upper right horizontal-U-shaped-clamp tube nuts 132,
33) Upper right horizontal-U-shaped-clamp pointed-tip screws 133,
34) Upper right vertical U-shaped clamp 134,
35) Upper right vertical-U-shaped-clamp screw openings 135,
36) Upper right vertical-U-shaped-clamp screws 136,
37) Upper right vertical-U-shaped-clamp tube nuts 137,
38) Upper right vertical-U-shaped-clamp pointed-tip screws 138,
39) Upper right middle-U-shaped-clamp front plate 139,
40) Upper right middle-U-shaped-clamp rear plate 140;
41) Lower right anti-warping anti-sagging triple-U-shaped-clamp bracket system 141, comprising:
42) Lower right horizontal U-shaped clamp 142,
43) Lower right horizontal-U-shaped-clamp screw openings 143,
44) Lower right horizontal-U-shaped-clamp screws 144,
45) Lower right horizontal-U-shaped-clamp tube nuts 145,
46) Lower right horizontal-U-shaped-clamp pointed-tip screws 146,
47) Lower right vertical U-shaped clamp 147,
48) Lower right vertical-U-shaped-clamp screw openings 148,
49) Lower right vertical-U-shaped-clamp screws 149,
50) Lower right vertical-U-shaped-clamp tube nuts 150,
51) Lower right vertical-U-shaped-clamp pointed-tip screws 151,
52) Lower right middle-U-shaped-clamp front plate 152,
53) Lower right middle-U-shaped-clamp rear plate 153,
54) Lower right truss ring 154;
55) Upper anti-warping anti-sagging interlocking-tube-nut hinge system 155, comprising:
56) Upper-hinge pin 156,
57) Upper J-shaped hinge plate 157,
58) Upper J-shaped-hinge-plate screw openings 158,
59) Upper J-shaped-hinge-plate screws 159,
60) Upper L-shaped hinge plate 160,
61) Upper L-shaped-hinge-plate screw openings 161,
62) Upper L-shaped-hinge-plate front screws 162,
63) Upper L-shaped-hinge-plate front tube nuts 163,
64) Upper L-shaped-hinge-plate side screws 164,
65) Upper L-shaped-hinge-plate side tube nuts 165;
66) Lower anti-warping anti-sagging interlocking-tube-nut hinge system 166, comprising:
67) Lower-hinge pin 167,
68) Lower J-shaped hinge plate 168,
69) Lower J-shaped-hinge-plate screw openings 169,
70) Lower J-shaped-hinge-plate screws 170,
71) Lower L-shaped hinge plate 171,
72) Lower L-shaped-hinge-plate screw openings 172,
73) Lower L-shaped-hinge-plate front screws 173,
74) Lower L-shaped-hinge-plate front tube nuts 174,
75) Lower L-shaped-hinge-plate side screws 175,
76) Lower L-shaped-hinge-plate side tube nuts 176;
77) Upper strut system 177, comprising:
78) Upper strut 178,
79) Upper-strut left-front recess 179,
80) Upper-strut left-rear recess 180,
81) Upper-strut left nut tunnels 181,
82) Upper-strut right-front recess 182,
83) Upper-strut right-rear recess 183,
84) Upper-strut right nut tunnels 184;
85) Lower strut system 185, comprising:
86) Lower strut 186,
87) Lower-strut left-front recess 187,
88) Lower-strut left-rear recess 188,
89) Lower-strut left nut tunnels 189,
90) Lower-strut right-front recess 190,
91) Lower-strut right-rear recess 191,
92) Lower-strut right nut tunnels 192;
93) Left strut system 193, comprising:
94) Left strut 194,
95) Left-strut upper-front recess 195,
96) Left-strut upper-rear recess 196,
97) Left-strut upper nut tunnels 197,
98) Left-strut lower-front recess 198,
99) Left-strut lower-rear recess 199,
100) Left-strut lower nut tunnels 200;
101) Right strut system 201, comprising:
102) Right strut 202,
103) Right-strut upper-front recess 203,
104) Right-strut upper-rear recess 204,
105) Right-strut upper nut tunnels 205,
106) Right-strut lower-front recess 206,
107) Right-strut lower-rear recess 207,
108) Right-strut lower nut tunnels 208;
109) Truss system 209, comprising:
110) Ring hook 210,
111) Turnbuckle 211,
112) Cable hook 212,
113) Truss cable 213,
114) Truss cable clamp 214;
115) Gate post system 215, comprising:
116) Post 216,
117) Upper L-shaped-hinge-plate front-tube-nut tunnels 217,
118) Upper L-shaped-hinge-plate side-tube-nut tunnels 218,
119) Lower L-shaped-hinge-plate front-tube-nut tunnels 219,
120) Lower L-shaped-hinge-plate side-tube-nut tunnels 220; and
121) Truss-cable-clamp tunnel system 221, comprising:
122) Truss-cable-clamp opening 222,
123) Truss-cable-clamp tunnel 223.

Material

Referring to FIGS. 3, 4, 5, 6A, 6B, 6C, 6D, 6E, 6F, 6G, 6H, 6I, 7A, 7B, 7C, 7D, and 7E:

1) Upper left anti-warping anti-sagging triple-U-shaped-clamp bracket system 101 is made of the combined materials of its components.
2) Upper left horizontal U-shaped clamp 102 is made of metallic material.
3) Upper left horizontal-U-shaped-clamp screw openings 103 each are made of empty space.
4) Upper left horizontal-U-shaped-clamp screws 104 each are made of metallic material.
5) Upper left horizontal-U-shaped-clamp tube nuts 105 each are made of metallic material.
6) Upper left horizontal-U-shaped-clamp pointed-tip screws 106 each are made of metallic material.
7) Upper left vertical U-shaped clamp 107 is made of metallic material.
8) Upper left vertical-U-shaped-clamp screw openings 108 each are made of empty space.
9) Upper left vertical-U-shaped-clamp screws 109 each are made of metallic material.

10) Upper left vertical-U-shaped-clamp tube nuts 110 each are made of metallic material.
11) Upper left vertical-U-shaped-clamp pointed-tip screws 111 each are made of metallic material.
12) Upper left middle-U-shaped-clamp front plate 112 is made of metallic material.
13) Upper left middle-U-shaped-clamp rear plate 113 is made of metallic material.
14) Upper left truss ring 114 is made of metallic material.
15) Lower left anti-warping anti-sagging triple-U-shaped-clamp bracket system 115 is made of the combined materials of its components.
16) Lower left horizontal U-shaped clamp 116 is made of metallic material.
17) Lower left horizontal-U-shaped-clamp screw openings 117 each are made of empty space.
18) Lower left horizontal-U-shaped-clamp screws 118 each are made of metallic material.
19) Lower left horizontal-U-shaped-clamp tube nuts 119 each are made of metallic material.
20) Lower left horizontal-U-shaped-clamp pointed-tip screws 120 each are made of metallic material.
21) Lower left vertical U-shaped clamp 121 is made of metallic material.
22) Lower left vertical-U-shaped-clamp screw openings 122 each are made of empty space.
23) Lower left vertical-U-shaped-clamp screws 123 each are made of metallic material.
24) Lower left vertical-U-shaped-clamp tube nuts 124 each are made of metallic material.
25) Lower left vertical-U-shaped-clamp pointed-tip screws 125 each are made of metallic material.
26) Lower left middle-U-shaped-clamp front plate 126 is made of metallic material.
27) Lower left middle-U-shaped-clamp rear plate 127 is made of metallic material.
28) Upper right anti-warping anti-sagging triple-U-shaped-clamp bracket system 128 is made of the combined materials of its components.
29) Upper right horizontal U-shaped clamp 129 is made of metallic material.
30) Upper right horizontal-U-shaped-clamp screw openings 130 each are made of empty space.
31) Upper right horizontal-U-shaped-clamp screws 131 each are made of metallic material.
32) Upper right horizontal-U-shaped-clamp tube nuts 132 each are made of metallic material.
33) Upper right horizontal-U-shaped-clamp pointed-tip screws 133 each are made of metallic material.
34) Upper right vertical U-shaped clamp 134 is made of metallic material.
35) Upper right vertical-U-shaped-clamp screw openings 135 each are made of empty space.
36) Upper right vertical-U-shaped-clamp screws 136 each are made of metallic material.
37) Upper right vertical-U-shaped-clamp tube nuts 137 each are made of metallic material.
38) Upper right vertical-U-shaped-clamp pointed-tip screws 138 each are made of metallic material.
39) Upper right middle-U-shaped-clamp front plate 139 is made of metallic material.
40) Upper right middle-U-shaped-clamp rear plate 140 is made of metallic material.
41) Lower right anti-warping anti-sagging triple-U-shaped-clamp bracket system 141 is made of the combined materials of its components.
42) Lower right horizontal U-shaped clamp 142 is made of metallic material.
43) Lower right horizontal-U-shaped-clamp screw openings 143 each are made of empty space.
44) Lower right horizontal-U-shaped-clamp screws 144 each are made of metallic material.
45) Lower right horizontal-U-shaped-clamp tube nuts 145 each are made of metallic material.
46) Lower right horizontal-U-shaped-clamp pointed-tip screws 146 each are made of metallic material.
47) Lower right vertical U-shaped clamp 147 is made of metallic material.
48) Lower right vertical-U-shaped-clamp screw openings 148 each are made of empty space.
49) Lower right vertical-U-shaped-clamp screws 149 each are made of metallic material.
50) Lower right vertical-U-shaped-clamp tube nuts 150 each are made of metallic material.
51) Lower right vertical-U-shaped-clamp pointed-tip screws 151 each are made of metallic material.
52) Lower right middle-U-shaped-clamp front plate 152 is made of metallic material.
53) Lower right middle-U-shaped-clamp rear plate 153 is made of metallic material.
54) Lower right truss ring 154 is made of metallic material.
55) Upper anti-warping anti-sagging interlocking-tube-nut hinge system 155 is made of the combined materials of its components.
56) Upper-hinge pin 156 is made of metallic material.
57) Upper J-shaped hinge plate 157 is made of metallic material.
58) Upper J-shaped-hinge-plate-screw openings 158 each are made of empty space.
59) Upper J-shaped-hinge-plate screws 159 each are made of metallic material.
60) Upper L-shaped hinge plate 160 is made of metallic material.
61) Upper L-shaped-hinge-plate screw openings 161 each are made of empty space.
62) Upper L-shaped-hinge-plate front screws 162 each are made of metallic material.
63) Upper L-shaped-hinge-plate front tube nuts 163 each are made of metallic material.
64) Upper L-shaped-hinge-plate side screws 164 each are made of metallic material.
65) Upper L-shaped-hinge-plate side tube nuts 165 each are made of metallic material.
66) Lower anti-warping anti-sagging interlocking-tube-nut hinge system 166 is made of the combined materials of its components.
67) Lower-hinge pin 167 is made of metallic material.
68) Lower J-shaped hinge plate 168 is made of metallic material.
69) Lower J-shaped-hinge-plate screw openings 169 each are made of empty space.
70) Lower J-shaped-hinge-plate screws 170 each are made of metallic material.
71) Lower L-shaped hinge plate 171 is made of metallic material.
72) Lower L-shaped-hinge-plate screw openings 172 each are made of empty space
73) Lower L-shaped-hinge-plate front screws 173 each are made of empty space.
74) Lower L-shaped-hinge-plate front tube nuts 174 each are made of metallic material.
75) Lower L-shaped-hinge-plate side screws 175 each are made of metallic material.

76) Lower L-shaped-hinge-plate side tube nuts 176 each are made of metallic material.
77) Upper strut system 177 is made of the combined materials of its components.
78) Upper strut 178 is made of wood.
79) Upper-strut left-front recess 179 is made of empty space.
80) Upper-strut left-rear recess 180 is made of empty space.
81) Upper-strut left nut tunnels 181 each are made of empty space.
82) Upper-strut right-front recess 182 is made of empty space.
83) Upper-strut right-rear recess 183 is made of empty space.
84) Upper-strut right nut tunnels 184 each are made of empty space.
85) Lower strut system 185 is made of the combined materials of its components.
86) Lower strut 186 is made of wood.
87) Lower-strut left-front recess 187 is made of empty space.
88) Lower-strut left-rear recess 188 is made of empty space.
89) Lower-strut left nut tunnels 189 each are made of empty space.
90) Lower-strut right-front recess 190 is made of empty space.
91) Lower-strut right-rear recess 191 is made of empty space.
92) Lower-strut right nut tunnels 192 each are made of empty space.
93) Left strut system 193 is made of the combined materials of its components.
94) Left strut 194 is made of wood.
95) Left-strut upper-front recess 195 is made of empty space.
96) Left-strut upper-rear recess 196 is made of empty space.
97) Left-strut upper nut tunnels 197 each are made of empty space.
98) Left-strut lower-front recess 198 is made of empty space.
99) Left-strut lower-rear recess 199 is made of empty space.
100) Left-strut lower nut tunnels 200 each are made of empty space.
101) Right strut system 201 is made of the combined materials of its components.
102) Right strut 202 is made of wood.
103) Right-strut upper-front recess 203 is made of empty space.
104) Right-strut upper-rear recess 204 is made of empty space.
105) Right-strut upper nut tunnels 205 each are made of empty space.
106) Right-strut lower-front recess 206 is made of empty space.
107) Right-strut lower-rear recess 207 is made of empty space.
108) Right-strut lower nut tunnels 208 each are made of empty space.
109) Truss system 209 is made of the combined materials of its components.
110) Ring hook 210 is made of metallic material.
111) Turnbuckle 211 is made of metallic material.
112) Cable hook 212 is made of metallic material.
113) Truss cable 213 is made of metallic material.
114) Truss cable clamp 214 is made of metallic material.
115) Gate post system 215 is made of the combined materials of its components.
116) Post 216 is made of wood.
117) Upper L-shaped-hinge-plate front-tube-nut tunnels 217 each are made of empty space.
118) Upper L-shaped-hinge-plate side-tube-nut tunnels 218 each are made of empty space.
119) Lower L-shaped-hinge-plate front-tube-nut tunnels 219 each are made of empty space.
120) Lower L-shaped-hinge-plate side-tube-nut tunnels 220 each are made of empty space.
121) Truss-cable-clamp tunnel system 221 is made of the combined materials of its components.
122) Truss-cable-clamp opening 222 is made of empty space.
123) Truss-cable-clamp tunnel 223 is made of empty space.

Shape

Referring to FIGS. 3, 4, 5, 6A, 6B, 6C, 6D, 6E, 6F, 6G, 6H, 6I, 7A, 7B, 7C, 7D, and 7E:

1) Upper left anti-warping anti-sagging triple-U-shaped-clamp bracket system 101 has the combined shapes of its components.
2) Upper left horizontal U-shaped clamp 102 has an elongated U shape.
3) Upper left horizontal-U-shaped-clamp screw openings 103 each have a round shape.
4) Upper left horizontal-U-shaped-clamp screws 104 each have a screw shape.
5) Upper left horizontal-U-shaped-clamp tube nuts 105 each have a tube shape.
6) Upper left horizontal-U-shaped-clamp pointed-tip screws 106 each have a screw shape.
7) Upper left vertical U-shaped clamp 107 has an elongated U shape.
8) Upper left vertical-U-shaped-clamp screw openings 108 each have a round shape.
9) Upper left vertical-U-shaped-clamp screws 109 each have a screw shape.
10) Upper left vertical-U-shaped-clamp tube nuts 110 each have a tube shape.
11) Upper left vertical-U-shaped-clamp pointed-tip screws 111 each have a screw shape.
12) Upper left middle-U-shaped-clamp front plate 112 has a rectangular shape.
13) Upper left middle-U-shaped-clamp rear plate 113 has a rectangular shape.
14) Upper left truss ring 114 has a ring shape.
15) Lower left anti-warping anti-sagging triple-U-shaped-clamp bracket system 115 has the combined shapes of its components.
16) Lower left horizontal U-shaped clamp 116 has an elongated U shape.
17) Lower left horizontal-U-shaped-clamp screw openings 117 each have a round shape.
18) Lower left horizontal-U-shaped-clamp screws 118 each have a screw shape.
19) Lower left horizontal-U-shaped-clamp tube nuts 119 each have a tube shape.
20) Lower left horizontal-U-shaped-clamp pointed-tip screws 120 each have a screw shape.
21) Lower left vertical U-shaped clamp 121 has an elongated U shape.
22) Lower left vertical-U-shaped-clamp screw openings 122 each have a round shape.
23) Lower left vertical-U-shaped-clamp screws 123 each have a screw shape.
24) Lower left vertical-U-shaped-clamp tube nuts 124 each have a tube shape.
25) Lower left vertical-U-shaped-clamp pointed-tip screws 125 each have a screw shape.

26) Lower left middle-U-shaped-clamp front plate 126 has a rectangular shape.
27) Lower left middle-U-shaped-clamp rear plate to 127 has a rectangular shape.
28) Upper right anti-warping anti-sagging triple-U-shaped-clamp bracket system 128 has the combined shapes of its components.
29) Upper right horizontal U-shaped clamp 129 has an elongated U shape.
30) Upper right horizontal-U-shaped-clamp screw openings 130 each have a round shape.
31) Upper right horizontal-U-shaped-clamp screws 131 each have a screw shape.
32) Upper right horizontal-U-shaped-clamp tube nuts 132 each have a tube shape.
33) Upper right horizontal-U-shaped-clamp pointed-tip screws 133 each have a screw shape.
34) Upper right vertical U-shaped clamp 134 has an elongated U shape.
35) Upper right vertical-U-shaped-clamp screw openings 135 each have a round shape.
36) Upper right vertical-U-shaped-clamp screws 136 each have a screw shape.
37) Upper right vertical-U-shaped-clamp tube nuts 137 each have a tube shape.
38) Upper right vertical-U-shaped-clamp pointed-tip screws 138 each have a screw shape.
39) Upper right middle-U-shaped-clamp front plate 139 has a rectangular shape.
40) Upper right middle-U-shaped-clamp rear plate 140 has a rectangular shape.
41) Lower right anti-warping anti-sagging triple-U-shaped-clamp bracket system 141 has the combined shapes of its components.
42) Lower right horizontal U-shaped clamp 142 has an elongated U shape.
43) Lower right horizontal-U-shaped-clamp screw openings 143 each have a round shape.
44) Lower right horizontal-U-shaped-clamp screws 144 each have a screw shape.
45) Lower right horizontal-U-shaped-clamp tube nuts 145 each have a tube shape.
46) Lower right horizontal-U-shaped-clamp pointed-tip screws 146 each have a screw shape.
47) Lower right vertical U-shaped clamp 147 has an elongated U shape.
48) Lower right vertical-U-shaped-clamp screw openings 148 each have a round shape.
49) Lower right vertical-U-shaped-clamp screws 149 each have a screw shape.
50) Lower right vertical-U-shaped-clamp tube nuts 150 each have a tube shape.
51) Lower right vertical-U-shaped-clamp pointed-tip screws 151 each have a screw shape.
52) Lower right middle-U-shaped-clamp front plate 152 has a rectangular shape.
53) Lower right middle-U-shaped-clamp rear plate 153 has a rectangular shape.
54) Lower right truss ring 154 has a ring shape.
55) Upper anti-warping anti-sagging interlocking-tube-nut hinge system 155 has the combined shapes of its components.
56) Upper-hinge pin 156 has a cylindrical shape.
57) Upper J-shaped hinge plate 157 has a rectangular shape.
58) Upper J-shaped-hinge-plate screw openings 158 each have a round shape.
59) Upper J-shaped-hinge-plate screws 159 each have a screw shape.
60) Upper L-shaped hinge plate 160 has a rectangular shape.
61) Upper L-shaped-hinge-plate screw openings 161 each have a round shape.
62) Upper L-shaped-hinge-plate front screws 162 each have a screw shape.
63) Upper L-shaped-hinge-plate front tube nuts 163 each have a tube shape.
64) Upper L-shaped-hinge-plate side screws 164 each have a screw shape.
65) Upper L-shaped-hinge-plate side tube nuts 165 each have a tube shape.
66) Lower anti-warping anti-sagging interlocking-tube-nut hinge system 166 has the combined shapes of its components.
67) Lower-hinge pin 167 has a cylindrical shape.
68) Lower J-shaped hinge plate 168 has a rectangular shape.
69) Lower J-shaped-hinge-plate screw openings 169 each have a round shape.
70) Lower J-shaped-hinge-plate screws 170 each have a screw shape.
71) Lower L-shaped-hinge-plate 171 has a rectangular shape.
72) Lower L-shaped-hinge-plate screw openings 172 each have a round shape.
73) Lower L-shaped-hinge-plate front screws 173 each have a screw shape.
74) Lower L-shaped-hinge-plate front tube nuts 174 each have a tube shape.
75) Lower L-shaped-hinge-plate side screws 175 each have a screw shape.
76) Lower L-shaped-hinge-plate side tube nuts 176 each have a tube shape.
77) Upper strut system 177 has the combined shapes of its components.
78) Upper strut 178 has a rectangular solid shape.
79) Upper-strut left-front recess 179 has a rectangular shape.
80) Upper-strut left-rear recess 180 has a rectangular shape.
81) Upper-strut left nut tunnels 181 each have a cylindrical shape.
82) Upper-strut right-front recess 182 has a rectangular shape.
83) Upper-strut right-rear recess 183 has a rectangular shape.
84) Upper-strut right nut tunnels 184 each have a cylindrical shape.
85) Lower strut system 185 has the combined shapes of its components.
86) Lower strut 186 has a rectangular solid shape.
87) Lower-strut left-front recess 187 has a rectangular shape.
88) Lower-strut left-rear recess 188 has a rectangular shape.
89) Lower-strut left nut tunnels 189 each have a cylindrical shape.
90) Lower-strut right-front recess 190 has a rectangular shape.
91) Lower-strut right-rear recess 191 has a rectangular shape.
92) Lower-strut right nut tunnels 192 each have a cylindrical shape.
93) Left strut system 193 has the combined shapes of its components.
94) Left strut 194 has a rectangular solid shape.
95) Left-strut upper-front recess 195 has a rectangular shape.
96) Left-strut upper-rear recess 196 has a rectangular shape.
97) Left-strut upper nut tunnels 197 each have a cylindrical shape.

98) Left-strut lower-front recess 198 has a rectangular shape.
99) Left-strut lower-rear recess 199 has a rectangular shape.
100) Left-strut lower nut tunnels 200 each have a cylindrical shape.
101) Right strut system 201 has the combined shapes of its components.
102) Right strut 202 has a rectangular solid shape.
103) Right-strut upper-front recess 203 has a rectangular shape.
104) Right-strut upper-rear recess 204 has a rectangular shape.
105) Right-strut upper nut tunnels 205 each have a cylindrical shape.
106) Right-strut lower-front recess 206 has a rectangular shape.
107) Right-strut lower-rear recess 207 has a rectangular shape.
108) Right-strut lower nut tunnels 208 each have a cylindrical shape.
109) Truss system 209 has the combined shapes of its components.
110) Ring hook 210 has an eye-bolt shape.
111) Turnbuckle 211 has an oblong ring shape.
112) Cable hook 212 has an eye-bolt shape.
113) Truss cable 213 has a cable shape.
114) Truss cable clamp 214 has a U shape.
115) Gate post system 215 has the combined shapes of its components.
116) Post 216 has a rectangular solid shape.
117) Upper L-shaped-hinge-plate front-tube-nut tunnels 217 each have a cylindrical shape.
118) Upper L-shaped-hinge-plate side-tube-nut tunnels 218 each have a cylindrical shape.
119) Lower L-shaped-hinge-plate front-tube-nut tunnels 219 each have a cylindrical shape.
120) Lower L-shaped-hinge-plate side-tube-nut tunnels 220 each have a cylindrical shape.
121) Truss-cable-clamp tunnel system 221 has the combined shapes of its components.
122) Truss-cable-clamp opening 222 has a round shape.
123) Truss-cable-clamp tunnel 223 has a cylindrical shape.

Connection

Referring to FIGS. 3, 4, 5, 6A, 6B, 6C, 6D, 6E, 6F, 6G, 6H, 6I, 7A, 7B, 7C, 7D, and 7E:

1) Upper left anti-warping anti-sagging triple-U-shaped-clamp bracket system 101 is welded to upper anti-warping anti-sagging interlocking-tube-nut hinge system 155, and is screwed to upper strut system 177 and left strut system 193.
2) Upper left horizontal U-shaped clamp 102 is welded to upper left vertical U-shaped clamp 107, and is screwed to upper strut 178.
3) Upper left horizontal-U-shaped-clamp screw openings 103 each are drilled in upper left horizontal U-shaped clamp 102.
4) Upper left horizontal-U-shaped-clamp screws 104 each are screwed through one upper left horizontal-U-shaped-clamp screw opening 103 and one upper left horizontal-U-shaped-clamp tube nut 105.
5) Upper left horizontal-U-shaped-clamp tube nuts 105 each are screwed on one upper left horizontal U-shaped-clamp screw 104 and upper strut 178.
6) Upper left horizontal-U-shaped-clamp pointed-tip screws 106 each are screwed one through upper left horizontal-U-shaped-clamp screw opening 103 and into upper strut 178.
7) Upper left vertical U-shaped clamp 107 is welded to upper left horizontal U-shaped clamp 102 and is screwed to left strut 194.
8) Upper left vertical-U-shaped-clamp screw openings 108 each are drilled in upper left vertical U-shaped clamp 107.
9) Upper left vertical-U-shaped-clamp screws 109 each are screwed through one upper left vertical-U-shaped-clamp screw opening 108 and one upper left vertical-U-shaped-clamp tube nuts 110.
10) Upper left vertical-U-shaped-clamp tube nuts 110 each are screwed on one upper left vertical U-shaped-clamp screw 109 and left strut 194.
11) Upper left vertical-U-shaped-clamp pointed-tip screws 111 each are screwed through one upper left vertical-U-shaped-clamp screw opening 108 and into left strut 194.
12) Upper left middle-U-shaped-clamp front plate 112 is welded to upper left horizontal U-shaped clamp 102, upper left vertical U-shaped clamp 107, and upper anti-warping anti-sagging interlocking-tube-nut hinge system 155.
13) Upper left middle-U-shaped-clamp rear plate 113 is welded to upper left horizontal U-shaped clamp 102, upper left vertical U-shaped clamp 107, and upper anti-warping anti-sagging interlocking-tube-nut hinge system 155.
14) Upper left truss ring 114 is welded to upper left horizontal U-shaped clamp 102 and upper left vertical U-shaped clamp 107.
15) Lower left anti-warping anti-sagging triple-U-shaped-clamp bracket system 115 is welded to lower anti-warping anti-sagging interlocking-tube-nut hinge system 166, and is screwed to lower strut system 185 and left strut system 193.
16) Lower left horizontal U-shaped clamp 116 is welded to lower left vertical U-shaped clamp 121 and is screwed to lower strut 194.
17) Lower left horizontal-U-shaped-clamp screw openings 117 each are drilled in upper left horizontal U-shaped clamp 116.
18) Lower left horizontal-U-shaped-clamp screws 118 each are screwed through one lower left horizontal-U-shaped-clamp screw opening 117 and one lower left horizontal-U-shaped-clamp tube nut 119.
19) Lower left horizontal-U-shaped-clamp tube nuts 119 each are screwed on one lower left horizontal U-shaped-clamp crew 118 and lower strut 186.
20) Lower left horizontal-U-shaped-clamp pointed-tip screws 120 each are screwed through one lower left horizontal-U-shaped-clamp screw opening 117 and into lower strut 186.
21) Lower left vertical U-shaped clamp 121 is welded to lower left horizontal U-shaped clamp 116 and is screwed to left strut 194.
22) Lower left vertical-U-shaped-clamp screw openings 122 each are drilled in lower left vertical U-shaped clamp 121.
23) Lower left vertical-U-shaped-clamp screws 123 each are screwed through one lower left vertical-U-shaped-clamp screw opening 122 and one lower left vertical-U-shaped-clamp tube nut 124.
24) Lower left vertical-U-shaped-clamp tube nuts 124 each are screwed on one lower left vertical U-shaped-clamp screw 123 and left strut 194.
25) Lower left vertical-U-shaped-clamp pointed-tip screws 125 each are screwed through one lower left vertical-U-shaped-clamp screw opening 122 and into left strut 194.
26) Lower left middle-U-shaped-clamp front plate 126 is welded to lower left horizontal U-shaped clamp 116, lower left vertical U-shaped clamp 121, and lower anti-warping anti-sagging interlocking-tube-nut hinge system 166.

27) Lower left middle-U-shaped-clamp rear plate 127 is welded to lower left horizontal U-shaped clamp 116, lower left vertical U-shaped clamp 121, and lower anti-warping anti-sagging interlocking-tube-nut hinge system 166.

28) Upper right anti-warping anti-sagging triple-U-shaped-clamp bracket system 128 is screwed to upper strut system 177 and right strut system 201.

29) Upper right horizontal U-shaped clamp 129 is welded to upper right vertical U-shaped clamp 134 and is screwed to upper strut 178.

30) Upper right horizontal-U-shaped-clamp screw openings 130 each are drilled in upper right horizontal U-shaped clamp 129.

31) Upper right horizontal-U-shaped-clamp screws 131 each are screwed through one upper right horizontal-U-shaped-clamp screw opening 130 and one upper right horizontal-U-shaped-clamp tube nut 132.

32) Upper right horizontal-U-shaped-clamp tube nuts 132 each are screwed on one upper right horizontal U-shaped-clamp screw 131 and upper strut 178.

33) Upper right horizontal-U-shaped-clamp pointed-tip screws 133 each are screwed through one upper right horizontal-U-shaped-clamp screw opening 130 and into upper strut 178.

34) Upper right vertical U-shaped clamp 134 is welded to upper right horizontal U-shaped clamp 129 and is screwed to right strut 202.

35) Upper right vertical-U-shaped-clamp screw openings 135 each are drilled in upper right vertical U-shaped clamp 134.

36) Upper right vertical-U-shaped-clamp screws 136 each are screwed through one upper right vertical-U-shaped-clamp screw opening 135 and one upper right vertical-U-shaped-clamp tube nut 137.

37) Upper right vertical-U-shaped-clamp tube nuts 137 each are screwed on one upper right vertical-U-shaped-clamp screw 136 and right strut 202.

38) Upper right vertical-U-shaped-clamp pointed-tip screws 138 each are screwed through one upper right vertical-U-shaped-clamp screw opening 135 and into right strut 202.

39) Upper right middle-U-shaped-clamp front plate 139 is welded to upper right horizontal U-shaped clamp 129 and upper right vertical U-shaped clamp 134.

40) Upper right middle-U-shaped-clamp rear plate 140 is welded to upper right horizontal U-shaped clamp 129 and upper right vertical U-shaped clamp 134.

41) Lower right anti-warping anti-sagging triple-U-shaped-clamp bracket system 141 is screwed to lower strut system 185 and right strut system 201.

42) Lower right horizontal U-shaped clamp 142 is welded to lower right vertical U-shaped clamp 147 and is screwed to lower strut 186.

43) Lower right horizontal-U-shaped-clamp screw openings 143 each are drilled in lower right horizontal U-shaped clamp 142.

44) Lower right horizontal-U-shaped-clamp screws 144 each are screwed through one lower right horizontal-U-shaped-clamp screw opening 143 and one lower right horizontal-U-shaped-clamp tube nut 145.

45) Lower right horizontal-U-shaped-clamp tube nuts 145 each are screwed on one lower right horizontal U-shaped-clamp screw 144 and lower strut 186.

46) Lower right horizontal-U-shaped-clamp pointed-tip screws 146 each are screwed through one lower right horizontal-U-shaped-clamp screw opening 143 and into lower strut 186.

47) Lower right vertical U-shaped clamp 147 is welded to lower right horizontal U-shaped clamp 142 and is screwed to right strut 202.

48) Lower right vertical-U-shaped-clamp screw openings 148 each are drilled in lower right vertical U-shaped clamp 147.

49) Lower right vertical-U-shaped-clamp screws 149 each are screwed through one lower right vertical-U-shaped-clamp screw opening 148 and one lower right vertical-U-shaped-clamp tube nut 150.

50) Lower right vertical-U-shaped-clamp tube nuts 150 each are screwed on one lower right vertical-U-shaped-clamp screw 149 and right strut 202.

51) Lower right vertical-U-shaped-clamp pointed-tip screws 151 each are screwed through one lower right vertical-U-shaped-clamp screw opening 148 and into right strut 202.

52) Lower right middle-U-shaped-clamp front plate 152 is welded to lower right horizontal U-shaped clamp 142 and lower right vertical U-shaped clamp 147.

53) Lower right middle-U-shaped-clamp rear plate 153 is welded to lower right horizontal U-shaped clamp 142 and lower right vertical U-shaped clamp 147.

54) Lower right truss ring 154 is welded to lower right horizontal U-shaped clamp 142 and lower right vertical U-shaped clamp 147.

55) Upper anti-warping anti-sagging interlocking-tube-nut hinge system 155 is welded to upper left anti-warping anti-sagging triple-U-shaped-clamp bracket system 101.

56) Upper-hinge pin 156 is attached to upper J-shaped-hinge-plate 157 and upper L-shaped hinge plate 160.

57) Upper J-shaped hinge plate 157 is welded to upper left horizontal U-shaped clamp 102, and is attached to upper-hinge pin 156.

58) Upper J-shaped-hinge-plate screw openings 158 each are drilled in upper J-shaped hinge plate 157.

59) Upper J-shaped-hinge-plate screws 159 each are screwed into upper strut 178 and left strut 194.

60) Upper L-shaped-hinge-plate 160 is attached to upper-hinge pin 156.

61) Upper L-shaped-hinge-plate screw openings 161 each are drilled in upper L-shaped hinge plate 160.

62) Upper L-shaped-hinge-plate front screws 162 each are screwed through one upper L-shaped-hinge-plate screw opening 161 and into one upper L-shaped-hinge-plate front tube nut 163.

63) Upper L-shaped-hinge-plate front tube nuts 163 each are inserted into one upper L-shaped-hinge-plate front-tube-nut tunnel 217, and are screwed on one upper L-shaped-hinge-plate front screw 162.

64) Upper L-shaped-hinge-plate side screws 164 each are screwed through one upper L-shaped-hinge-plate screw opening 161 and into one upper L-shaped-hinge-plate side tube nut 165.

65) Upper L-shaped-hinge-plate side tube nuts 165 each are welded to upper L-shaped hinge plate 160 and are inserted into one upper L-shaped-hinge-plate side-tube-nut tunnel 218.

66) Lower anti-warping anti-sagging interlocking-tube-nut hinge system 166 is welded to lower left anti-warping anti-sagging triple-U-shaped-clamp bracket system 115.

67) Lower-hinge pin 167 is attached to lower J-shaped-hinge-plate 168 and lower L-shaped hinge plate 171.

68) Lower J-shaped hinge plate 168 is welded to lower left horizontal U-shaped clamp 116, and is attached to lower-hinge pin 167.

69) Lower J-shaped-hinge-plate screw openings 169 each are drilled in lower J-shaped hinge plate 168.

70) Lower J-shaped-hinge-plate screws 170 each are screwed into lower strut 186 and left strut 194.

71) Lower L-shaped hinge plate 171 is attached to lower-hinge pin 167.

72) Lower L-shaped-hinge-plate screw openings 172 each are drilled in lower L-shaped-hinge-plate 171.

73) Lower L-shaped-hinge-plate front screws 173 each are screwed through one lower L-shaped-hinge-plate screw opening 172 and into one lower L-shaped-hinge-plate front tube nut 174.

74) Lower L-shaped-hinge-plate front tube nuts 174 each are inserted into one lower L-shaped-hinge-plate front-tube-nut tunnel 219, and are screwed on one lower L-shaped-hinge-plate front screw 173.

75) Lower L-shaped-hinge-plate side screws 175 each are attached to lower L-shaped hinge plate 171 and post 216.

76) Lower L-shaped-hinge-plate side tube nuts 176 each are welded to lower L-shaped hinge plate 171 and are inserted into one lower L-shaped-hinge-plate side-tube-nut tunnel 220.

77) Upper strut system 177 is attached to upper left anti-warping anti-sagging triple-U-shaped-clamp bracket system 101 and upper right anti-warping anti-sagging triple-U-shaped-clamp bracket system 128.

78) Upper strut 178 is attached to upper left horizontal U-shaped clamp 102 and upper right horizontal U-shaped clamp 129.

79) Upper-strut left-front recess 179 is cut into upper strut 178.

80) Upper-strut left-rear recess 180 is cut into upper strut 178.

81) Upper-strut left nut tunnels 181 each are drilled in upper strut 178.

82) Upper-strut right-front recess 182 is cut into upper strut 178.

83) Upper-strut right-rear recess 183 is cut into upper strut 178.

84) Upper-strut right nut tunnels 184 each are drilled in upper strut 178.

85) Lower strut system 185 is attached to lower left anti-warping anti-sagging triple-U-shaped-clamp bracket system 115 and lower right anti-warping anti-sagging triple-U-shaped-clamp bracket system 141.

86) Lower strut 186 is attached to lower left horizontal U-shaped clamp 116 and lower right horizontal U-shaped clamp 142.

87) Lower-strut left-front recess 187 is cut into lower strut 186.

88) Lower-strut left-rear recess 188 is cut into lower strut 186.

89) Lower-strut left nut tunnels 189 each are drilled in lower strut 186.

90) Lower-strut right-front recess 190 is cut into lower strut 186.

91) Lower-strut right-rear recess 191 is cut into lower strut 186.

92) Lower-strut right nut tunnels 192 each are drilled in lower strut 186.

93) Left strut system 193 is attached to upper left anti-warping anti-sagging triple-U-shaped-clamp bracket system 101 and lower left anti-warping anti-sagging triple-U-shaped-clamp bracket system 115.

94) Left strut 194 is attached to upper left vertical U-shaped clamp 107 and lower left vertical U-shaped clamp 121.

95) Left-strut upper-front recess 195 is cut into left strut 194.

96) Left-strut upper-rear recess 196 is cut into left strut 194.

97) Left-strut upper nut tunnels 197 each are drilled in left strut 194.

98) Left-strut lower-front recess 198 is cut into left strut 194.

99) Left-strut lower-rear recess 199 is cut into left strut 194.

100) Left-strut lower nut tunnels 200 each are drilled in left strut 194.

101) Right strut system 201 is attached to upper right anti-warping anti-sagging triple-U-shaped-clamp bracket system 128 and lower right anti-warping anti-sagging triple-U-shaped-clamp bracket system 141.

102) Right strut 202 is attached to upper right vertical U-shaped clamp 134 and lower right vertical U-shaped clamp 147.

103) Right-strut upper-front recess 203 is cut into right strut 202.

104) Right-strut upper-rear recess 204 is cut into right strut 202.

105) Right-strut upper nut tunnels 205 each are drilled in right strut 202.

106) Right-strut lower-front recess 206 is cut into right strut 202.

107) Right-strut lower-rear recess 207 is cut into right strut 202.

108) Right-strut lower nut tunnels 208 each are drilled in right strut 202.

109) Truss system 209 is attached to upper left anti-warping anti-sagging triple-U-shaped-clamp bracket system 101 and lower right anti-warping anti-sagging triple-U-shaped-clamp bracket system 141.

110) Ring hook 210 is hooked on upper left truss ring 114.

111) Turnbuckle 211 is screwed to ring hook 210.

112) Cable hook 212 is screwed to turnbuckle 211.

113) Truss cable 213 is hooked on cable hook 212, and is threaded through truss-cable-clamp opening 222 into truss-cable-clamp tunnel 223.

114) Truss cable clamp 214 is attached to truss cable 213.

115) Gate post system 215 is attached to upper anti-warping anti-sagging interlocking-tube-nut hinge system 155 and lower anti-warping anti-sagging interlocking-tube-nut hinge system 166.

116) Post 216 is attached to upper anti-warping anti-sagging interlocking-tube-nut hinge system 155 and lower anti-warping anti-sagging interlocking-tube-nut hinge system 166.

117) Upper L-shaped-hinge-plate front-tube-nut tunnels 217 each are drilled in post 216.

118) Upper L-shaped-hinge-plate side-tube-nut tunnels each are drilled in post 216.

119) Lower L-shaped-hinge-plate front-tube-nut tunnels 219 each are drilled in post 216.

120) Lower L-shaped-hinge-plate side-tube-nut tunnels 220 each are drilled in post 216.

121) Truss-cable-clamp tunnel system 221 is drilled in lower right horizontal U-shaped clamp 142 and lower strut 186.

122) Truss-cable-clamp opening 222 is drilled in lower right horizontal U-shaped clamp 142.

123) Truss-cable-clamp tunnel 223 is drilled in lower strut 186.

Function

Referring to FIGS. 3, 4, 5, 6A, 6B, 6C, 6D, 6E, 6F, 6G, 6H, 6I, 7A, 7B, 7C, 7D, and 7E:

1) Upper left anti-warping anti-sagging triple-U-shaped-clamp bracket system 101 is for preventing the corner of the unique gate from warping and sagging.

2) Upper left horizontal U-shaped clamp 102 is for:
Clamping on upper strut 178,
Securing upper strut 178,
Providing a solid structural support for upper strut 178, and
Preventing upper strut 178 from warping and sagging.

3) Upper left horizontal-U-shaped-clamp screw openings 103 each are for screwing one upper left horizontal-U-shaped-clamp screw 104 through.

4) Upper left horizontal-U-shaped-clamp screws 104 each are for:
Interlocking upper left horizontal U-shaped clamp 102 with upper strut 178, and
Securing upper left horizontal U-shaped clamp 102 to upper strut 178.

5) Upper left horizontal-U-shaped-clamp tube nuts 105 each are for:
Interlocking upper left horizontal U-shaped clamp 102 with upper strut 178, and
Providing a solid structural connection between upper left horizontal U-shaped clamp 102 and upper strut 178.

6) Upper left horizontal-U-shaped-clamp pointed-tip screws 106 each are for:
Interlocking upper left horizontal U-shaped clamp 102 with upper strut 178, and
Additionally securing upper left horizontal U-shaped clamp 102 to upper strut 178.

7) Upper left vertical U-shaped clamp 107 is for:
Clamping on left strut 194,
Securing left strut 194,
Providing a solid structural support for left strut 194, and
Preventing left strut 194 from warping and sagging.

8) Upper left vertical-U-shaped-clamp screw openings 108 each are for screwing one upper left vertical-U-shaped-clamp screw 109 through.

9) Upper left vertical-U-shaped-clamp screws 109 each are for:
Interlocking upper left vertical U-shaped clamp 107 with left strut 194, and
Securing upper left vertical U-shaped clamp 107 to left strut 194.

10) Upper left vertical-U-shaped-clamp tube nuts 110 each are for:
Interlocking upper left vertical U-shaped clamp 107 with left strut 194, and
Providing a solid structural connection between upper left vertical U-shaped clamp 107 and left strut 194.

11) Upper left vertical-U-shaped-clamp pointed-tip screws 111 each are for:
Interlocking upper left vertical U-shaped clamp 107 with left strut 194, and
Additionally securing upper left vertical U-shaped clamp 107 to left strut 194.

12) Upper left middle-U-shaped-clamp front plate 112 is for:
Clamping left strut 194,
Securing left strut 194,
Providing a solid structural support for left strut 194, and
Preventing left strut 194 from warping and sagging.

13) Upper left middle-U-shaped-clamp rear plate 113 is for:
Clamping left strut 194,
Securing left strut 194,
Providing a solid structural support for left strut 194, and
Preventing left strut 194 from warping and sagging.

14) Upper left truss ring 114 is for attaching truss system 209 to upper left anti-warping anti-sagging triple-U-shaped-clamp bracket system 101.

15) Lower left anti-warping anti-sagging triple-U-shaped-clamp bracket system 115 is for preventing the corner of the unique gate from warping and sagging.

16) Lower left horizontal U-shaped clamp 116 is for:
Clamping on lower strut 186,
Securing lower strut 186,
Providing a solid structural support for lower strut 186, and
Preventing lower strut 186 from warping and sagging.

17) Lower left horizontal-U-shaped-clamp screw openings 117 each are for screwing one lower left horizontal-U-shaped-clamp screw 118 through.

18) Lower left horizontal-U-shaped-clamp screws 118 each are for:
Interlocking lower left horizontal U-shaped clamp 116 with lower strut 186, and
Securing lower left horizontal U-shaped clamp 116 to lower strut 186.

19) Lower left horizontal-U-shaped-clamp tube nuts 119 each are for:
Interlocking lower left horizontal U-shaped clamp 116 with lower strut 186, and
Providing a solid structural connection between lower left horizontal U-shaped clamp 116 and lower strut 186.

20) Lower left horizontal-U-shaped-clamp pointed-tip screws 120 each are for:
Interlocking lower left horizontal U-shaped clamp 116 with lower strut 186, and
Additionally securing lower left horizontal U-shaped clamp 116 to lower strut 186.

21) Lower left vertical U-shaped clamp 121 is for:
Clamping on left strut 194,
Securing left strut 194,
Providing a solid structural support for left strut 194, and
Preventing left strut 194 from warping and sagging.

22) Lower left vertical-U-shaped-clamp screw openings 122 each are for screwing one lower left vertical-U-shaped-clamp screw 123 through.

23) Lower left vertical-U-shaped-clamp screws 123 each are for:
Interlocking lower left vertical U-shaped clamp 121 with left strut 194, and
Securing lower left vertical U-shaped clamp 116 to left strut 194.

24) Lower left vertical-U-shaped-clamp tube nuts 124 each are for:
Interlocking lower left vertical U-shaped clamp 121 with left strut 194, and
Providing a solid structural connection between lower left vertical U-shaped clamp 121 and left strut 194.

25) Lower left vertical-U-shaped-clamp pointed-tip screws 125 each are for:
Interlocking lower left vertical U-shaped clamp 121 with left strut 194, and
Additionally securing lower left vertical U-shaped clamp 121 to left strut 194.

26) Lower left middle-U-shaped-clamp front plate 126 is for:
Clamping left strut 194,
Securing left strut 194,
Providing a solid structural support for left strut 194, and
Preventing left strut 194 from warping and sagging.

27) Lower left middle-U-shaped-clamp rear plate 127 is for:
Clamping left strut 194, Securing left strut 194,
Providing a solid structural support for left strut 194, and
Preventing left strut 194 from warping and sagging.

28) Upper right anti-warping anti-sagging triple-U-shaped-clamp bracket system 128 is for preventing the corner of the unique gate from warping and sagging.

29) Upper right horizontal U-shaped clamp 129 is for:
Clamping on upper strut 178,
Securing upper strut 178,
Providing a solid structural support for upper strut 178, and
Preventing upper strut 178 from warping and sagging.

30) Upper right horizontal-U-shaped-clamp screw openings 130 each are for screwing one upper right horizontal-U-shaped-clamp screw 131 through.

31) Upper right horizontal-U-shaped-clamp screws 131 each are for:
Interlocking upper right horizontal U-shaped clamp 129 with upper strut 178, and
Securing upper right horizontal U-shaped clamp 129 to upper strut 178.

32) Upper right horizontal-U-shaped-clamp tube nuts 132 each are for:
Interlocking upper right horizontal U-shaped clamp 129 with upper strut 178, and
Providing a solid structural connection between upper right horizontal U-shaped clamp 129 and upper strut 178.

33) Upper right horizontal-U-shaped-clamp pointed-tip screws 133 each are for:
Interlocking upper right horizontal U-shaped clamp 129 with upper strut 178, and
Additionally securing upper right horizontal U-shaped clamp 129 to upper strut 178.

34) Upper right vertical U-shaped clamp 134 is for:
Clamping on right strut 202,
Securing right strut 202,
Providing a solid structural support for right strut 202, and
Preventing right strut 202 from warping and sagging.

35) Upper right vertical-U-shaped-clamp screw openings 135 each are for screwing one upper right vertical-U-shaped-clamp screw 136 through.

36) Upper right vertical-U-shaped-clamp screws 136 each are for:
Interlocking upper right vertical U-shaped clamp 134 with right strut 202, and
Securing upper right vertical U-shaped clamp 134 to right strut 202.

37) Upper right vertical-U-shaped-clamp tube nuts 137 each are for:
Interlocking upper right vertical U-shaped clamp 134 with right strut 202, and
Providing a solid structural connection between upper right vertical U-shaped clamp 134 and right strut 202.

38) Upper right vertical-U-shaped-clamp pointed-tip screws 138 each are for:
Interlocking upper right vertical U-shaped clamp 134 with right strut 202, and
Additionally securing upper right vertical U-shaped clamp 134 to right strut 202.

39) Upper right middle-U-shaped-clamp front plate 139 is for:
Clamping right strut 202,
Securing right strut 202,
Providing a solid structural support for right strut 202, and
Preventing right strut 202 from warping and sagging.

40) Upper right middle-U-shaped-clamp rear plate 140 is for:
Clamping right strut 202,
Securing right strut 202,
Providing a solid structural support for right strut 202, and
Preventing right strut 202 from warping and sagging.

41) Lower right anti-warping anti-sagging triple-U-shaped-clamp bracket system 141 is for:
Preventing the corner of the unique gate from warping and sagging,
Locking the end of truss cable 213 inside truss-cable-clamp tunnel 223, and
Locking truss cable clamp 214 inside truss-cable-clamp tunnel 223.

42) Lower right horizontal U-shaped clamp 142 is for:
Clamping on lower strut 186,
Securing lower strut 186,
Providing a solid structural support for lower strut 186, and
Preventing lower strut 186 from warping and sagging.

43) Lower right horizontal-U-shaped-clamp screw openings 143 each are for screwing one lower right horizontal-U-shaped-clamp screw 144 through.

44) Lower right horizontal-U-shaped-clamp screws 144 each are for:
Interlocking lower right horizontal U-shaped clamp 142 with lower strut 186, and
Securing lower right horizontal U-shaped clamp 142 to lower strut 186.

45) Lower right horizontal-U-shaped-clamp tube nuts 145 each are for:
Interlocking lower right horizontal U-shaped clamp 142 with lower strut 186, and
Providing a solid structural connection between lower right horizontal U-shaped clamp 142 and lower strut 186.

46) Lower right horizontal-U-shaped-clamp pointed-tip screws 146 each are for:
Interlocking lower right horizontal U-shaped clamp 142 with lower strut 186, and
Additionally securing lower right horizontal U-shaped clamp 142 to lower strut 186.

47) Lower right vertical U-shaped clamp 147 is for:
Clamping on right strut 202,
Securing right strut 202,
Providing a solid structural support for right strut 202, and
Preventing right strut 202 from warping and sagging.

48) Lower right vertical-U-shaped-clamp screw openings 148 each are for screwing one lower right vertical-U-shaped-clamp screw 149 through.

49) Lower right vertical-U-shaped-clamp screws 149 each are for:
Interlocking lower right vertical U-shaped clamp 147 with right strut 202, and
Securing lower right vertical U-shaped clamp 147 to right strut 202.

50) Lower right vertical-U-shaped-clamp tube nuts 150 each are for:
Interlocking lower right vertical U-shaped clamp 147 with right strut 202, and
Providing a solid structural connection between lower right vertical U-shaped clamp 147 and right strut 202.

51) Lower right vertical-U-shaped-clamp pointed-tip screws 151 each are for:
Interlocking lower right vertical U-shaped clamp 147 with right strut 202, and Additionally securing lower right vertical U-shaped clamp 147 to right strut 202.

52) Lower right middle-U-shaped-clamp front plate 152 is for:
Clamping right strut 202,
Securing right strut 202,
Providing a solid structural support for right strut 202, and
Preventing right strut 202 from warping and sagging.

53) Lower right middle-U-shaped-clamp rear plate 153 is for:
Clamping right strut 202,
Securing right strut 202,
Providing a solid structural support for right strut 202, and
Preventing right strut 202 from warping and sagging.

54) Lower right truss ring 154 is for attaching truss system 209 to lower right anti-warping anti-sagging triple-U-shaped-clamp bracket system 141.

55) Upper anti-warping anti-sagging interlocking-tube-nut hinge system 155 is for:
Interlocking upper L-shaped-hinge-plate front tube nuts 163 with upper L-shaped-hinge-plate side tube nuts 165,
Interlocking upper L-shaped-hinge-plate front screws 162 with upper L-shaped-hinge-plate side screws 164,
Interlocking upper anti-warping anti-sagging interlocking-tube-nut hinge system 155 with post 216, and
Preventing the unique gate from warping and sagging.

56) Upper-hinge pin 156 is for connecting upper J-shaped-hinge-plate 157 to upper L-shaped hinge plate 160.

57) Upper J-shaped hinge plate 157 is for providing a swingable structural connection between upper left anti-warping anti-sagging triple-U-shaped-clamp bracket system 101 and upper L-shaped hinge plate 160.

58) Upper J-shaped-hinge-plate-screw openings 158 each are for screwing one upper J-shaped-hinge-plate screw 159 through.

59) Upper J-shaped-hinge-plate screws 159 each are for securing upper J-shaped hinge plate 157 to left strut 194.

60) Upper L-shaped hinge plate 160 is for providing a swingable structural connection between upper J-shaped hinge plate 157 and post 216.

61) Upper L-shaped-hinge-plate screw openings 161 each are for screwing one upper L-shaped-hinge-plate front screw 162 or one upper L-shaped-hinge-plate side screw 164 through.

62) Upper L-shaped-hinge-plate front screws 162 each are for:
Interlocking themselves with upper L-shaped-hinge-plate side screws 164, and
Securing upper L-shaped hinge plate 160 to post 216.

63) Upper L-shaped-hinge-plate front tube nuts 163 each are for:
Interlocking themselves with upper L-shaped-hinge-plate side tube nuts 165, and
Providing a solid structural connection between upper L-shaped hinge plate 160 and post 216.

64) Upper L-shaped-hinge-plate side screws 164 each are for:
Interlocking themselves with upper L-shaped-hinge-plate front screws 162, and
Securing upper L-shaped hinge plate 160 to post 216.

65) Upper L-shaped-hinge-plate side tube nuts 165 each are for:
Interlocking themselves with upper L-shaped-hinge-plate front tube nuts 163, and
Providing a solid structural connection between upper L-shaped hinge plate 160 and post 216.

66) Lower anti-warping anti-sagging interlocking-tube-nut hinge system 166 is for:
Interlocking lower L-shaped-hinge-plate front tube nuts 174 with lower L-shaped-hinge-plate side tube nuts 176,
Interlocking lower L-shaped-hinge-plate front screws 173 with lower L-shaped-hinge-plate side screws 175,
Interlocking lower anti-warping anti-sagging interlocking-tube-nut hinge system 166 with post 216, and
Preventing the unique gate from warping and sagging.

67) Lower-hinge pin 167 is for connecting lower J-shaped-hinge plate 168 to lower L-shaped hinge plate 171.

68) Lower J-shaped hinge plate 168 is for providing a swingable structural connection between lower left anti-warping anti-sagging triple-U-shaped-clamp bracket system 115 and lower L-shaped hinge plate 171.

69) Lower J-shaped-hinge-plate screw openings 169 each are for screwing one lower J-shaped-hinge-plate screw 170 through.

70) Lower J-shaped-hinge-plate screws 170 each are for securing lower J-shaped-hinge-plate 168 to left strut 194.

71) Lower L-shaped hinge plate 171 is for providing a swingable structural connection between lower J-shaped hinge plate 168 and post 216.

72) Lower L-shaped-hinge-plate screw openings 172 each are for screwing one lower L-shaped-hinge-plate front screw 173 or one lower L-shaped-hinge-plate side screws 175 through.

73) Lower L-shaped-hinge-plate front screws 173 each are for:
Interlocking themselves with lower L-shaped-hinge-plate side screws 175, and
Securing lower L-shaped hinge plate 171 to post 216.

74) Lower L-shaped-hinge-plate front tube nuts 174 each are for:
Interlocking themselves with lower L-shaped-hinge-plate side tube nuts 176, and
Providing a solid structural connection between lower L-shaped hinge plate 171 and post 216.

75) Lower L-shaped-hinge-plate side screws 175 each are for:
Interlocking themselves with lower L-shaped-hinge-plate front screws 173,
Securing lower L-shaped hinge plate 171 to post 216.

76) Lower L-shaped-hinge-plate side tube nuts 176 each are for:
Interlocking themselves with lower L-shaped-hinge-plate front tube nuts 174, and
Providing a solid structural connection between lower L-shaped hinge plate 171 and post 216.

77) Upper strut system 177 is for providing an upper framework for the unique gate.

78) Upper strut 178 is for providing an upper horizontal framework between left strut 194 and right strut 202.

79) Upper-strut left-front recess 179 is for providing a space for upper left horizontal U-shaped clamp 102 to fit into.

80) Upper-strut left-rear recess 180 is for providing a space for upper left horizontal U-shaped clamp 102 to fit into.

81) Upper-strut left nut tunnels 181 each are for providing a space for one upper left horizontal-U-shaped-clamp tube nut 105 to be inserted into.

82) Upper-strut right-front recess 182 is for providing a space for upper right horizontal U-shaped clamp 129 to fit into.

83) Upper-strut right-rear recess 183 is for providing a space for upper right horizontal U-shaped clamp 129 to fit into.

84) Upper-strut right nut tunnels 184 each are for providing a space for one upper right horizontal-U-shaped-clamp tube nut 132 to be inserted into.

85) Lower strut system 185 is for providing a lower framework for the unique gate.

86) Lower strut 186 is for providing a lower horizontal framework between left strut 194 and right strut 202.

87) Lower-strut left-front recess 187 is for providing a space for lower left horizontal U-shaped clamp 116 to fit into.

88) Lower-strut left-rear recess 188 is for providing a space for lower left horizontal U-shaped clamp 116 to fit into.

89) Lower-strut left nut tunnels 189 each are for providing a space for one lower left horizontal-U-shaped-clamp tube nut 119 to be inserted into.

90) Lower-strut right-front recess 190 is for providing a space for lower right horizontal U-shaped clamp 142 to fit into.

91) Lower-strut right-rear recess 191 is for providing a space for lower right horizontal U-shaped clamp 142 to fit into.

92) Lower-strut right nut tunnels 192 each are for providing a space for one lower right horizontal-U-shaped-clamp tube nut 145 to be inserted into.

93) Left strut system 193 is for providing a left framework for the unique gate.

94) Left strut 194 is for providing a vertical framework between upper strut 178 and lower strut 186.

95) Left-strut upper-front recess 195 is for providing a space for upper left vertical U-shaped clamp 107 to fit into.

96) Left-strut upper-rear recess 196 is for providing a space for upper left vertical U-shaped clamp 107 to fit into.

97) Left-strut upper nut tunnels 197 each are for providing a space for one upper left vertical-U-shaped-clamp tube nut 110 to be inserted into.

98) Left-strut lower-front recess 198 is for providing a space for lower left vertical U-shaped clamp 121 to fit into.

99) Left-strut lower-rear recess 199 is for providing a space for lower left vertical U-shaped clamp 121 to fit into.

100) Left-strut lower nut tunnels 200 each are for providing a space for one lower left vertical-U-shaped-clamp tube nut 124 to be inserted into.

101) Right strut system 201 is for providing a right framework for the unique gate.

102) Right strut 202 is for providing a vertical framework between upper strut 178 and lower strut 186.

103) Right-strut upper-front recess 203 is for providing a space for upper right vertical U-shaped clamp 134 to fit into.

104) Right-strut upper-rear recess 204 is for providing a space for upper right vertical U-shaped clamp 134 to fit into.

105) Right-strut upper nut tunnels 205 each are for providing a space for one upper right vertical-U-shaped-clamp tube nut 137 to be inserted into.

106) Right-strut lower-front recess 206 is for providing a space for lower right vertical U-shaped clamp 147 to fit into.

107) Right-strut lower-rear recess 207 is for providing a space for lower right vertical U-shaped clamp 147 to fit into.

108) Right-strut lower nut tunnels 208 each are for providing a space for one lower right vertical-U-shaped-clamp tube nut 150 to be inserted into.

109) Truss system 209 is for adjusting the tension of the unique-gate framework to keep it square.

110) Ring hook 210 is for attaching turnbuckle 211 to upper left truss ring 114.

111) Turnbuckle 211 is for tightening truss cable 213.

112) Cable hook 212 is for attaching truss cable 213 to turnbuckle 211.

113) Truss cable 213 is for keeping the unique gate square.

114) Truss cable clamp 214 is for securing truss cable 213 to lower right anti-warping anti-sagging triple-U-shaped-clamp bracket system 141.

115) Gate post system 215 is for:

Interlocking with upper and lower anti-warping anti-sagging interlocking-tube-nut hinge systems 155 and 166, and Providing a supporting structure for upper and lower anti-warping anti-sagging interlocking-tube-nut hinge systems 155 and 166 to be attached to.

116) Post 216 is for:

Interlocking with upper and lower anti-warping anti-sagging interlocking-tube-nut hinge systems 155 and 166, and Providing a supporting structure for upper and lower anti-warping anti-sagging interlocking-tube-nut hinge systems 155 and 166 to be attached to.

117) Upper L-shaped-hinge-plate front-tube-nut tunnels 217 each are for one upper L-shaped-hinge-plate front tube nut 163 to be inserted into.

118) Upper L-shaped-hinge-plate side-tube-nut tunnels 218 each are for one upper L-shaped-hinge-plate side tube nut 165 to be inserted into.

119) Lower L-shaped-hinge-plate front-tube-nut tunnels 219 each are for one lower L-shaped-hinge-plate front tube nut 174 to be inserted into.

120) Lower L-shaped-hinge-plate side-tube-nut tunnels 220 each are for one lower L-shaped-hinge-plate side tube nut 176 to be inserted into.

121) Truss-cable-clamp tunnel system 221 is for locking truss cable clamp 214 therein.

122) Truss-cable-clamp opening 222 is for truss cable 213 to be threaded therethrough.

123) Truss-cable-clamp tunnel 223 is for:

Hiding the end of truss cable 213 therein, and

Hiding truss cable clamp 214 therein.

Operation

Figure 3:
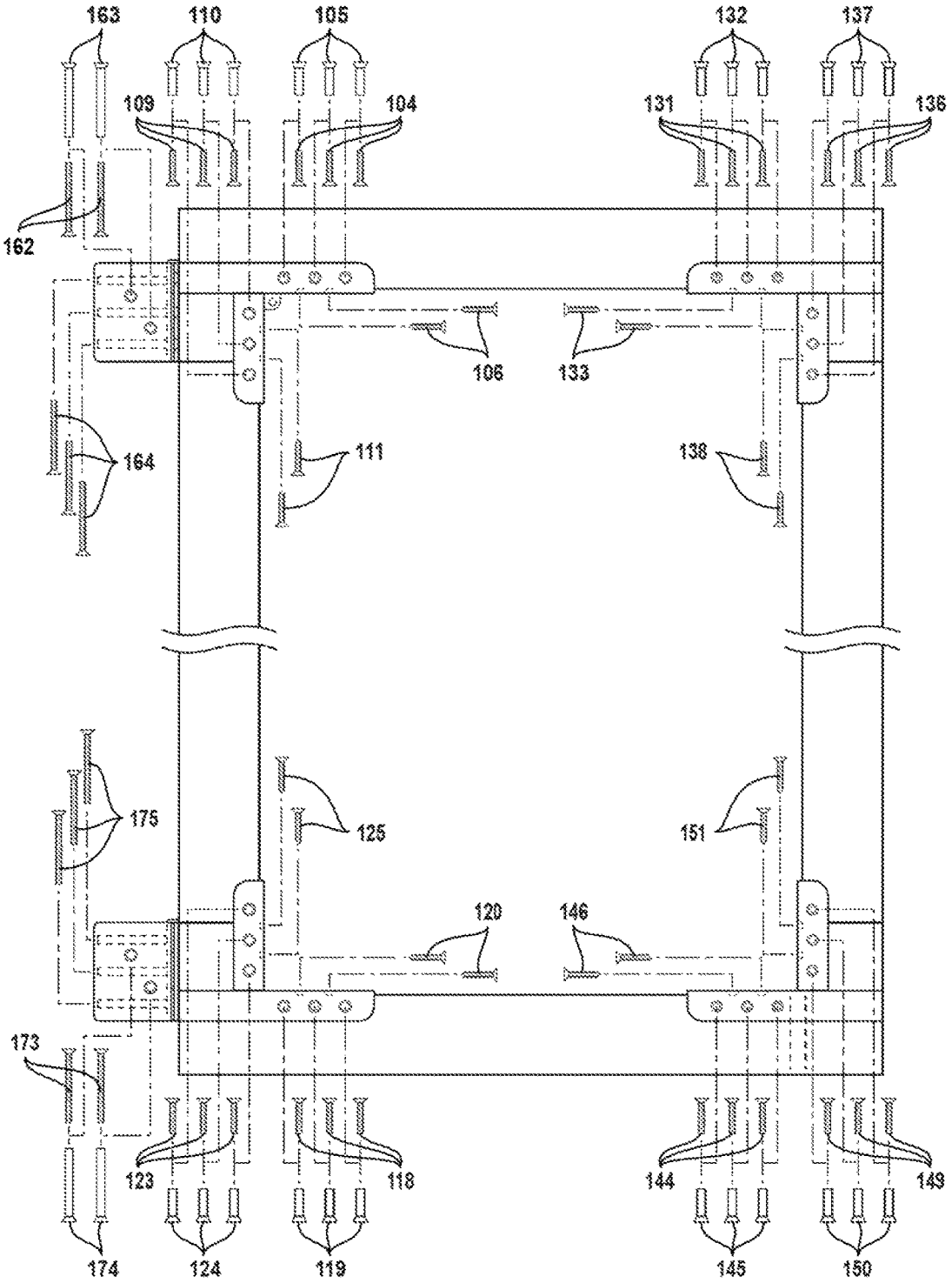
FIGS. 3, 4, and 5 illustrate a unique anti-warping anti-sagging interlocking gate, having multiple anti-warping anti-sagging interlocking triple-U-shaped-clamp bracket systems, multiple anti-warping anti-sagging interlocking L-shaped-plate hinge systems, and multiple anti-warping anti-sagging interlocking-tube-nut systems.

Referring to FIGS. 3, 6A, 6B, 6C, 6D, 6E, 6H, 6I, 7A, 7B, 7C, 7D, 7E, 8A, and 8B, the operation of the unique anti-warping anti-sagging interlocking gate, having multiple anti-warping anti-sagging interlocking triple-U-shaped-clamp bracket systems, multiple anti-warping anti-sagging interlocking L-shaped-plate hinge systems, and multiple anti-warping anti-sagging interlocking-tube-nut systems, comprises:

1) Sliding upper left horizontal U-shaped clamp 102 into upper-strut left-front recess 179 and upper-strut left-rear recess 180 (FIGS. 3, 7A, 7B, 7C, 7D, and 7E);

2) Sliding lower left horizontal U-shaped clamp 116 into lower-strut left-front recess 187 and upper-strut left-rear recess 188;

3) Sliding upper right horizontal U-shaped clamp 129 into upper-strut right-front recess 182 and upper-strut right-rear recess 183;

4) Sliding lower right horizontal U-shaped clamp 142 into lower-strut right-front recess 190 and lower-strut right-rear recess 191;

5) Screwing upper left horizontal-U-shaped-clamp pointed-tip screws 106 through upper left horizontal-U-shaped-clamp screw openings 103 into upper strut 178 (FIG. 3);

6) Screwing lower left horizontal-U-shaped-clamp pointed-tip screws 120 through lower left horizontal-U-shaped-clamp screw openings 117 into lower strut 186;

7) Screwing upper right horizontal-U-shaped-clamp pointed-tip screws 133 through upper right horizontal-U-shaped-clamp screw openings 130 into upper strut 178;

8) Screwing lower right horizontal-U-shaped-clamp pointed-tip screws 146 through lower right horizontal-U-shaped-clamp screw openings 143 into lower strut 186:
   To interlock U-shaped clamps 102, 116, 129, and 142 with struts 178 and 186,
   To additionally secure U-shaped clamps 102, 116, 129, and 142 to struts 178 and 186,
   To prevent strut 178, strut 186, and the unique gate from warping and sagging;

9) Inserting upper left horizontal-U-shaped-clamp tube nuts 105 into upper left horizontal-U-shaped-clamp screw openings 103 (FIGS. 3, 7A, 7B, 7C, 7D, and 7E);

10) Inserting lower left horizontal-U-shaped-clamp tube nuts 119 into lower left horizontal-U-shaped-clamp screw openings 117;

11) Inserting upper right horizontal-U-shaped-clamp tube nuts 132 into upper right horizontal-U-shaped-clamp screw openings 130;

12) Inserting lower right horizontal-U-shaped-clamp tube nuts 145 into lower right horizontal-U-shaped-clamp screw openings 143;

13) Screwing upper left horizontal-U-shaped-clamp screws 104 into upper left horizontal-U-shaped-clamp tube nuts 105 (FIGS. 3, 7A, 7B, 7C, 7D, and 7E);

14) Screwing lower left horizontal-U-shaped-clamp screws 118 into lower left horizontal-U-shaped-clamp tube nuts 119;

15) Screwing upper right horizontal-U-shaped-clamp screws 131 into upper right horizontal-U-shaped-clamp tube nuts 132;

16) Screwing lower right horizontal-U-shaped-clamp screws 144 into lower right horizontal-U-shaped-clamp tube nuts 145:
   To interlock U-shaped clamps 102, 116, 129, and 142 with struts 178 and 186,
   To provide solid structural connections between U-shaped clamps 102, 116, 129, and 142 and struts 178 and 186,
   To clamp U-shaped clamps 102, 116, 129, and 142 on struts 178 and 186,
   To secure U-shaped clamps 102, 116, 129, and 142 to struts 178 and 186,
   To provide solid structural supports for struts 178 and 186, and
   To prevent strut 178, strut 186, and the unique gate from warping and sagging;

17) Sliding upper left vertical U-shaped clamp 107 into left-strut upper-front recess 195 and left-strut upper-rear recess 196 (FIGS. 3, 7A, 7B, 7C, 7D, and 7E);

18) Sliding lower left vertical U-shaped clamp 121 into right-strut upper-front recess 203 and right-strut upper-rear recess 204;

19) Sliding upper right vertical U-shaped clamp 134 into left-strut lower-front recess 198 and left-strut lower-rear recess 199;

20) Sliding lower right vertical U-shaped clamp 147 into right-strut lower-front recess 206 and right-strut lower-rear recess 207;

21) Screwing upper left vertical-U-shaped-clamp pointed-tip screws 111 through upper left vertical-U-shaped-clamp screw openings 108 into left strut 194 (FIG. 3);

22) Screwing lower left vertical-U-shaped-clamp pointed-tip screws 125 through lower left vertical-U-shaped-clamp screw openings 122 into left strut 194;

23) Screwing upper right vertical-U-shaped-clamp pointed-tip screws 138 through upper right vertical-U-shaped-clamp screw openings 135 into right strut 202;

24) Screwing lower right vertical-U-shaped-clamp pointed-tip screws 151 through lower right vertical-U-shaped-clamp screw openings 148 into right strut 202;
   To interlock U-shaped clamps 107, 121, 134, and 147 with struts 194 and 202,
   To additionally secure U-shaped clamps 107, 121, 134, and 147 to struts 194 and 202,
   To prevent strut 194, strut 202, and the unique gate from warping and sagging;

25) Inserting upper left vertical-U-shaped-clamp tube nuts 110 into upper left vertical-U-shaped-clamp screw openings 108 (FIGS. 3, 7A, 7B, 7C, 7D, and 7E);

26) Inserting lower left vertical-U-shaped-clamp tube nuts 124 into lower left vertical-U-shaped-clamp screw openings 122;

27) Inserting upper right vertical-U-shaped-clamp tube nuts 137 into upper right vertical-U-shaped-clamp screw openings 135;

28) Inserting lower right vertical-U-shaped-clamp tube nuts 150 into lower right vertical-U-shaped-clamp screw openings 148;

29) Screwing upper left vertical-U-shaped-clamp screws 109 into upper left vertical-U-shaped-clamp tube nuts 110 (FIGS. 3, 7A, 7B, 7C, 7D, and 7E);

30) Screwing lower left vertical-U-shaped-clamp screws 123 into lower left vertical-U-shaped-clamp tube nuts 124;

31) Screwing upper right vertical-U-shaped-clamp screws 136 into upper right vertical-U-shaped-clamp tube nuts 137;

32) Screwing lower right vertical-U-shaped-clamp screws 149 into lower right vertical-U-shaped-clamp tube nuts 150:
   To interlock U-shaped clamps 107, 121, 134, and 147 with struts 194 and 202,
   To provide solid structural connections between U-shaped clamps 107, 121, 134, and 147 and struts 194 and 202,
   To clamp U-shaped clamps 107, 121, 134, and 147 on struts 194 and 202,
   To secure U-shaped clamps 107, 121, 134, and 147 to struts 194 and 202,
   To provide solid structural supports for struts 194 and 202, and
   To prevent strut 194, strut 202, and the unique gate from warping and sagging;

33) Inserting upper L-shaped-hinge-plate side tube nuts 165 into upper L-shaped-hinge-plate side-tube-nut tunnels 218 (FIGS. 3, 6A, 6B, 6C, 6D, 6E, 6H, and 6I);

34) Inserting lower L-shaped-hinge-plate side tube nuts 176 into lower L-shaped-hinge-plate side-tube-nut tunnels 220;

35) Inserting upper L-shaped-hinge-plate front tube nuts 163 into upper L-shaped-hinge-plate front-tube-nut tunnels 217;

36) Inserting lower L-shaped-hinge-plate front tube nuts 174 into lower L-shaped-hinge-plate front-tube-nut tunnels 219;

37) Screwing upper L-shaped-hinge-plate side screws 164 into upper L-shaped-hinge-plate side tube nuts 165 (FIGS. 3, 6A, 6B, 6C, 6D, 6E, 6H, and 6I);

38) Screwing lower L-shaped-hinge-plate side screws 175 into lower L-shaped-hinge-plate side tube nuts 176;

39) Screwing upper L-shaped-hinge-plate front screws 162 into upper L-shaped-hinge-plate front tube nuts 163;

40) Screwing lower L-shaped-hinge-plate front screws 173 into lower L-shaped-hinge-plate front tube nuts 174:
To interlock L-shaped hinge plates 160 and 171 with post 216,
To provide solid structural connections between L-shaped hinge plates 160 and 171 and post 216,
To clamp L-shaped hinge plates 160 and 171 on post 216,
To secure L-shaped hinge plates 160 and 171 to post 216,
To provide solid structural supports for the unique gate, and
To prevent the unique gate from warping and sagging;
41) Hooking ring hook 210 on upper left truss ring 114 (FIG. 8A);
42) Screwing turnbuckle 211 on ring hook 210;
43) Hooking truss cable 213 on cable hook 212;
44) Threading truss cable 213 through truss-cable-clamp opening 222 and truss-cable-clamp tunnel 223 (FIGS. 8A and 8B);
45) Clamping truss cable clamp 214 on the ends of truss cable 213 (FIGS. 8A and 8B);
46) Screwing cable hook 212 on turnbuckle 211 (FIGS. 8A and 8B):
To pull truss cable clamp 214 and the ends of truss cable 213 inside truss-cable-clamp tunnel 223, and
To hide truss cable clamp 214 and the ends of truss cable 213 inside truss-cable-clamp tunnel 223;
47) Rotating turnbuckle 211 to adjust truss cable 213 to a desired tension (FIGS. 8A and 8B);
48) Screwing gate boards 124 on upper strut 178 and lower strut 186 (FIGS. 8A and 8B); and
49) Swinging the unique gate in the direction of arrow 125 (FIG. 6D).

Variation

Figure 9A:
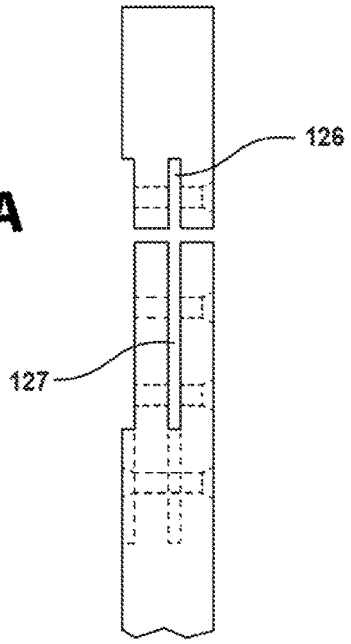
FIGS. 9A and 9B illustrate side views of a variation of the upper right anti-warping anti-sagging triple-U-shaped-clamp bracket system.
Figure 9B:
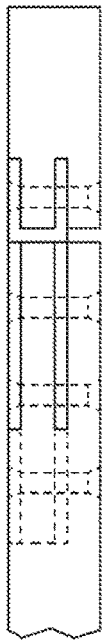
Figure 10:
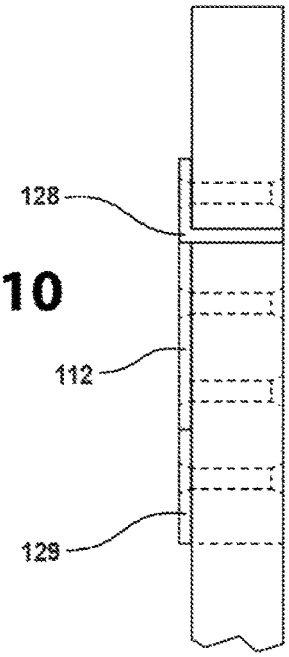
FIG. 10 illustrates a side view of another variation of the upper right anti-warping anti-sagging triple-U-shaped-clamp bracket system.
Figure 11:
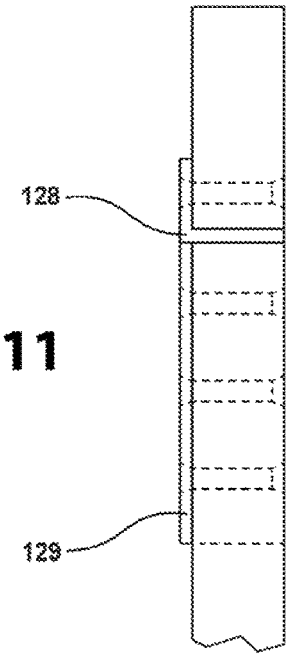
FIG. 11 illustrates a side view of another variation of the upper right anti-warping anti-sagging triple-U-shaped-clamp bracket system.
Figure 12:
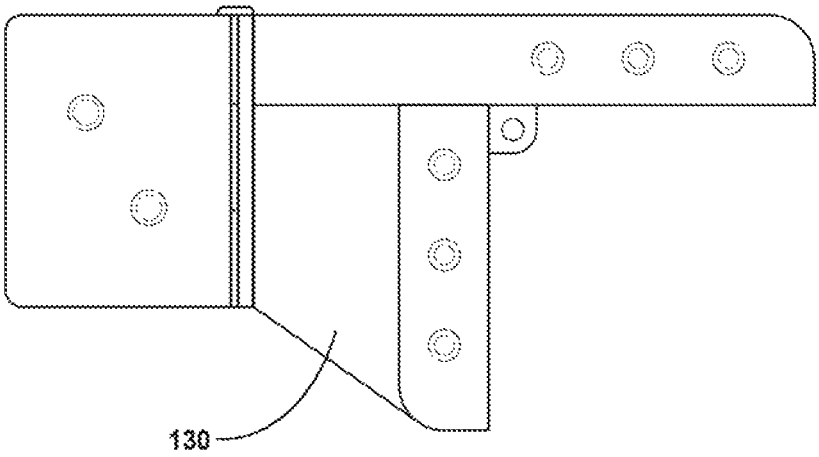
FIG. 12 illustrates a side view of a variation of the upper left middle-U-shaped-clamp front plate and the upper left middle-U-shaped-clamp rear plate of the upper left anti-warping anti-sagging triple-U-shaped-clamp bracket system.
Figure 13:
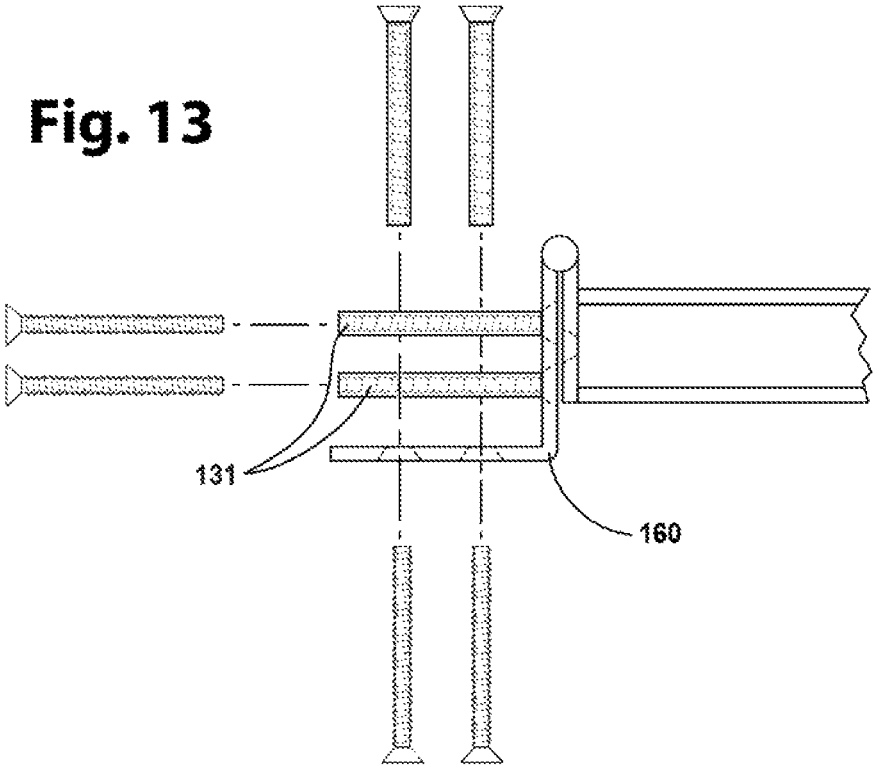
FIG. 13 illustrates a top view of a variation of the upper anti-warping anti-sagging interlocking-tube-nut hinge system.
Figure 14:
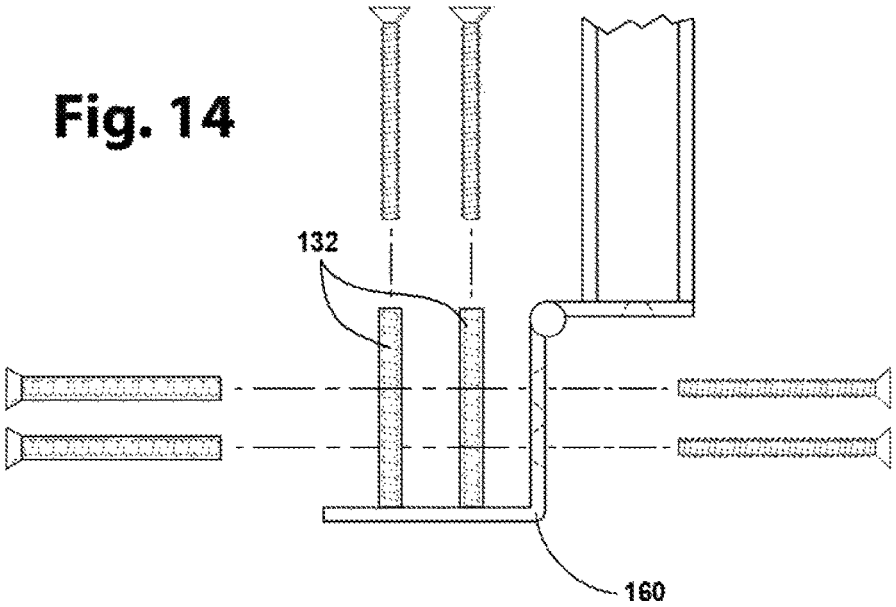
FIG. 14 illustrates a top view of another variation of the upper anti-warping anti-sagging interlocking-tube-nut hinge system.
Figure 15:
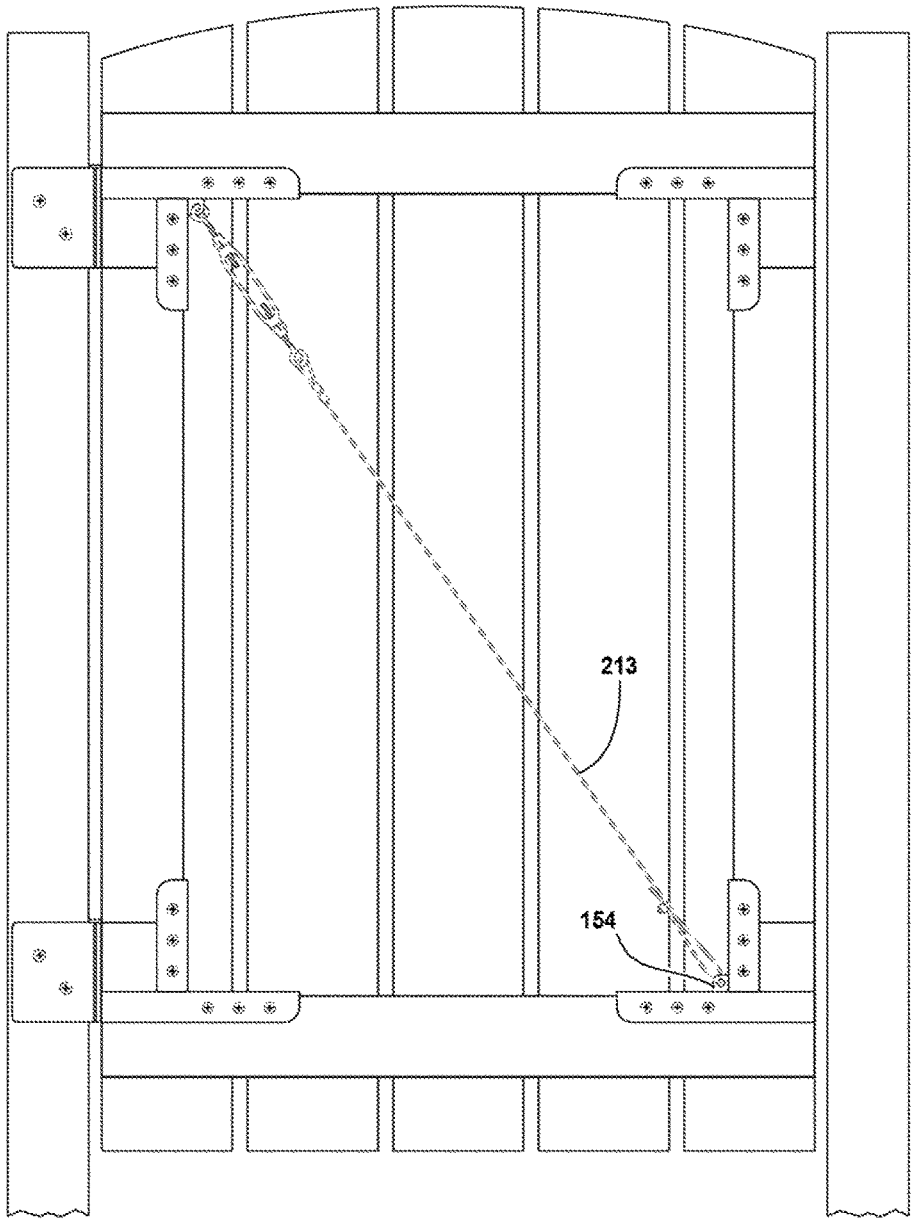
FIG. 15 illustrates a front view of a variation of the truss system of the unique anti-warping anti-sagging interlocking gate.
Figure 16:
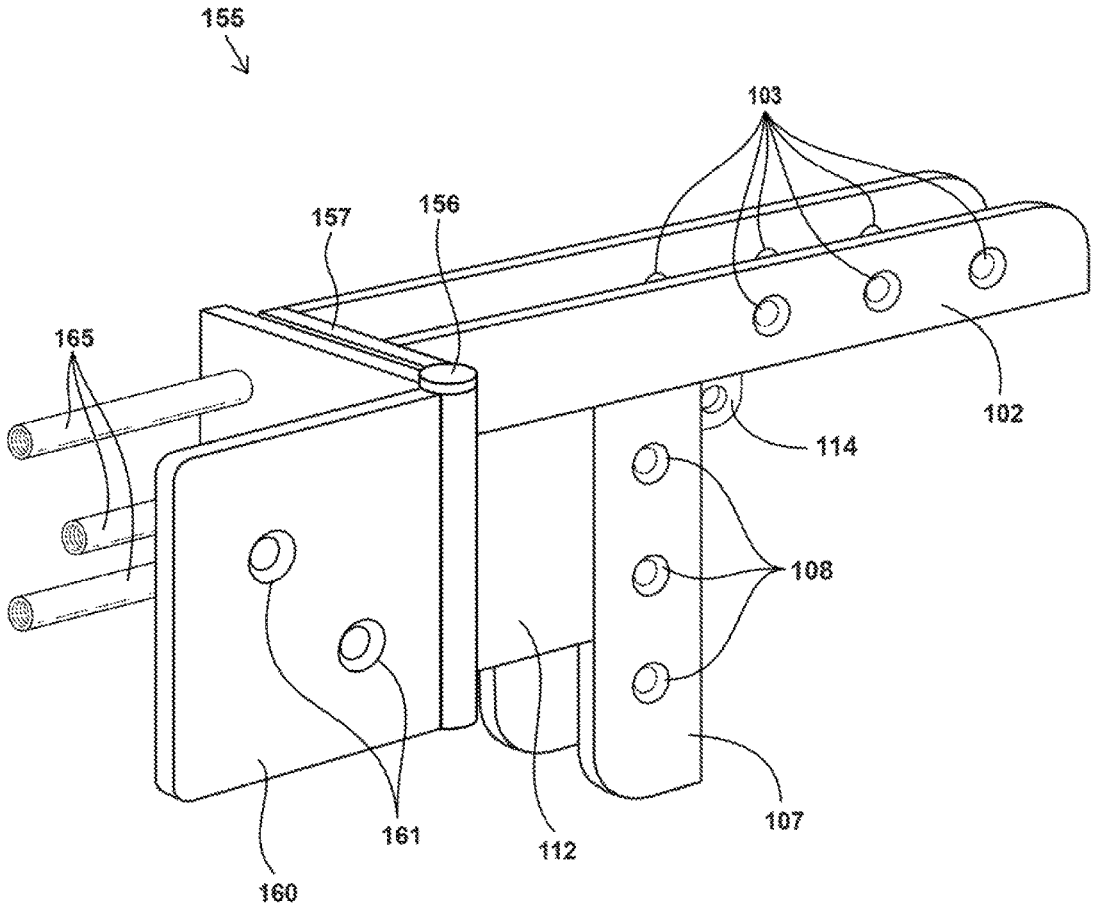
FIGS. 16, 17, 18, and 19 illustrate perspective and top views of a variation of the truss system of the unique anti-warping anti-sagging interlocking gate.
Figure 17:
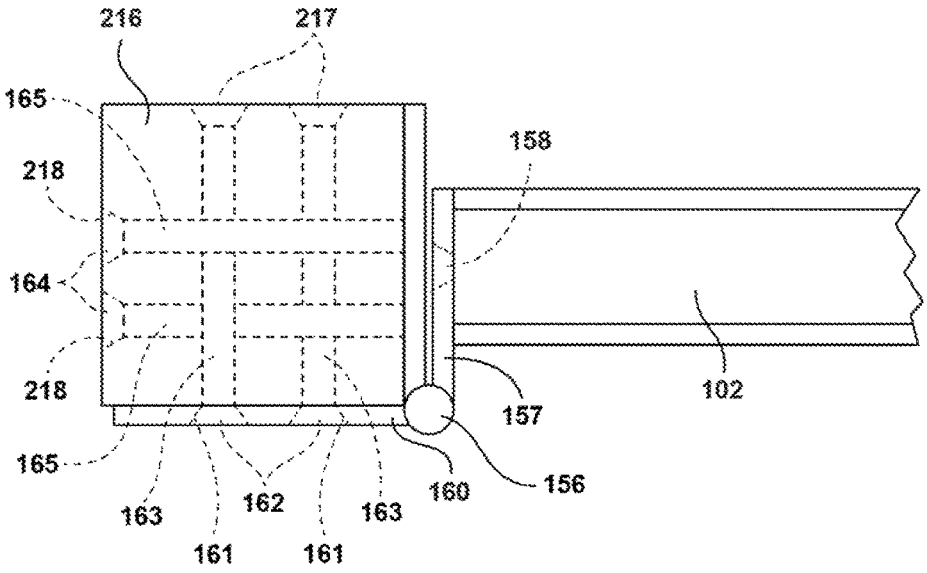
Figure 18:
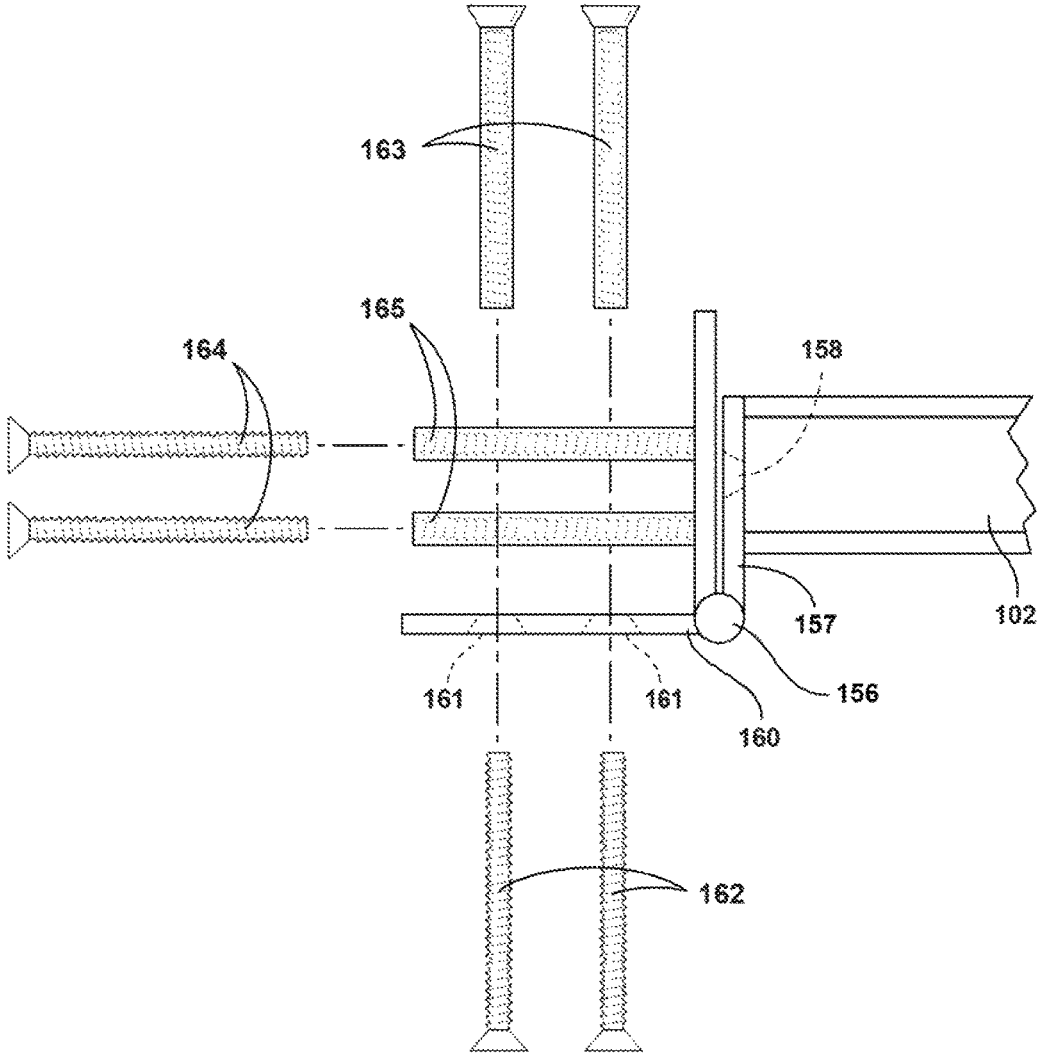
Figure 19:
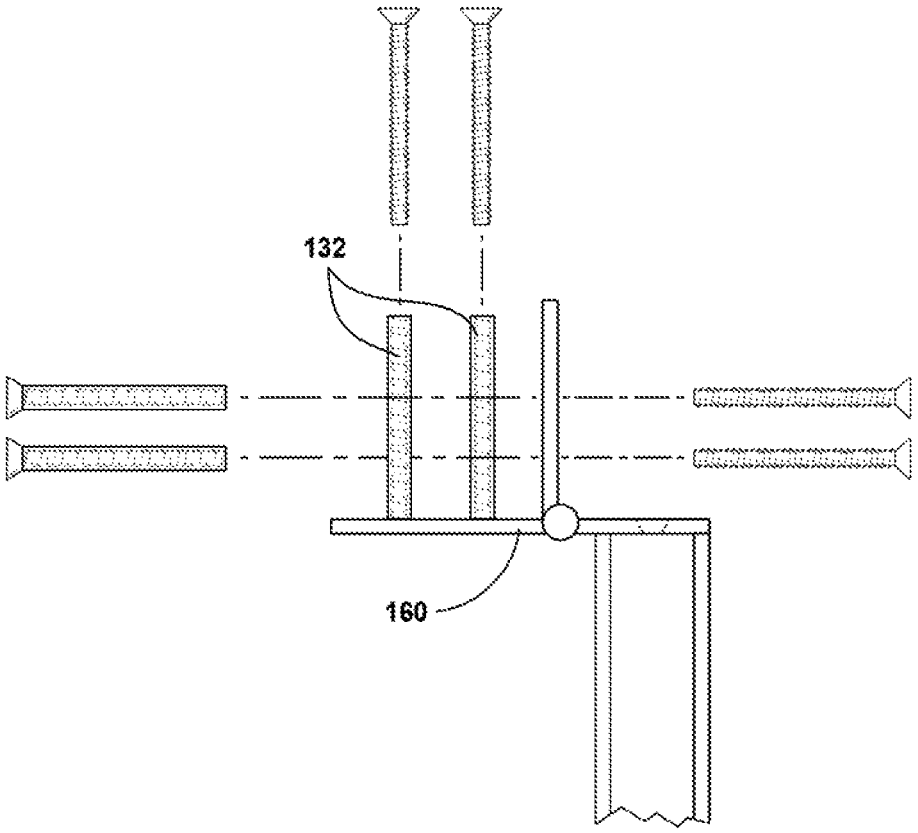
Figure 20:
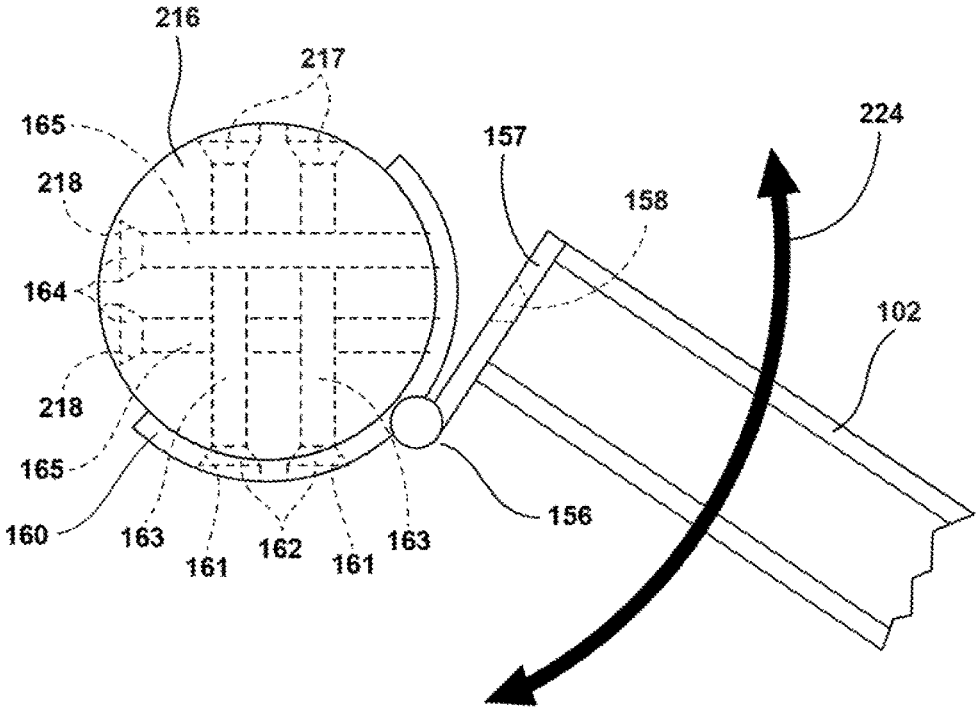
FIG. 20 illustrates a top view of a variation of the truss system of the unique anti-warping anti-sagging interlocking gate.
Figure 21:
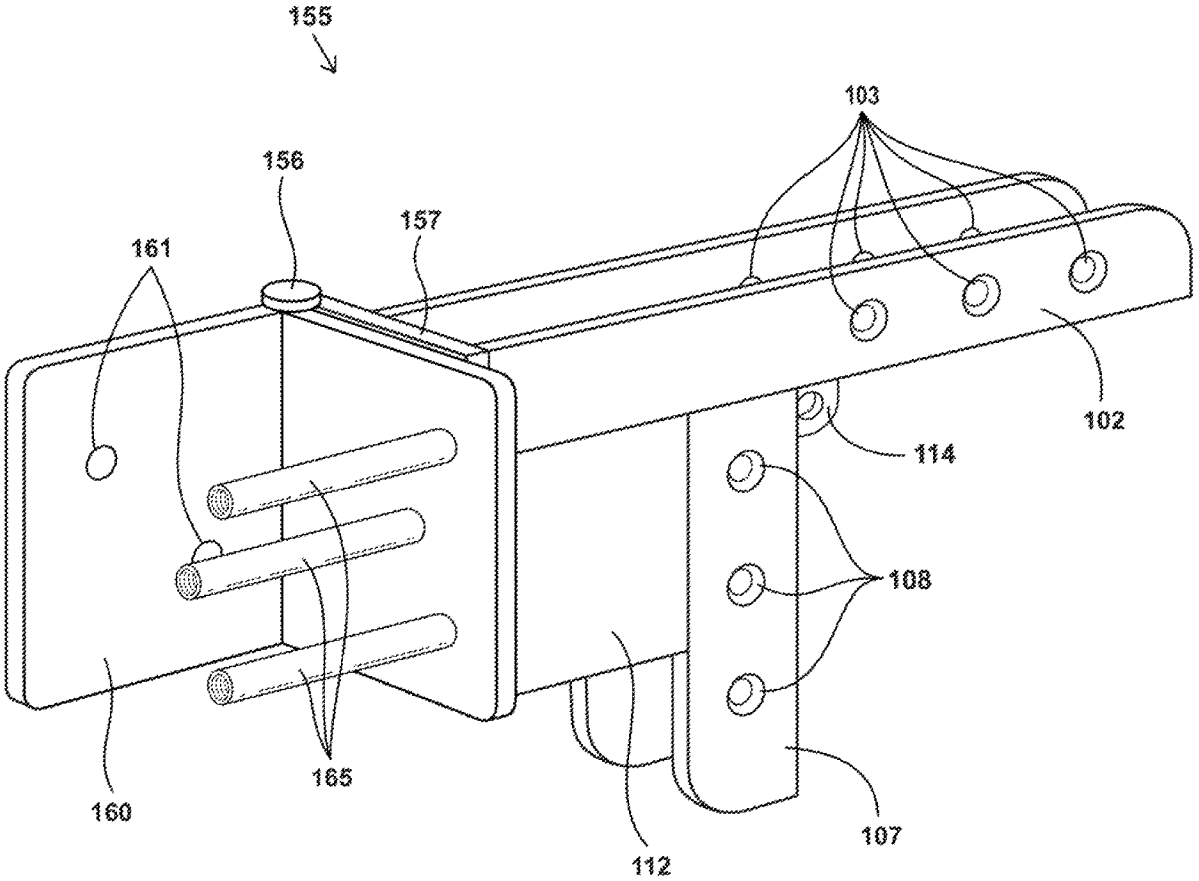
FIG. 21 illustrates a perspective view of a variation of the truss system of the unique anti-warping anti-sagging interlocking gate.

Each component of the unique anti-warping anti-sagging interlocking gate can have any shape and size. Each recess of the unique anti-warping anti-sagging interlocking gate can be disposed at any location and/or replaced with a groove. For example, grooves 126 and 127, equivalent to upper-strut right-rear recess 183 and right-strut upper-rear recess 204 can be disposed at different locations together with upper right horizontal U-shaped clamp 129 and upper right vertical U-shaped clamp 134, respectively, (FIGS. 9A and 9B). Each clamp of the unique anti-warping anti-sagging interlocking gate can have a cross-section of any shape and size. For example, clamps 128 and 129, equivalent to clamp 102 and clamp 107, each can have an L-shaped cross-section, respectively (FIG. 10). Each bracket system of the unique anti-warping anti-sagging interlocking gate can be made with or without a front plate and/or a rear plate. For example, a bracket system, equivalent to bracket system 101, can be made with front plate 112 (FIG. 10), or without plate 112 (FIG. 11). Each combination of a screw tunnel, a screw, and a tube nut of the unique anti-warping anti-sagging interlocking gate can be replaced with any screw. Each plate of any bracket system of the unique anti-warping anti-sagging interlocking gate can have any shape and size. For example, a plate 130, equivalent to plate 112 or 113, can have a trapezoidal shape (FIG. 12). Each tube nut of any bracket system of the unique anti-warping anti-sagging interlocking gate can be welded thereon or screwed thereon. For example, tube nuts 131 are screwed on upper L-shaped hinge plate 160 (FIG. 13). For another example, tube nuts 132 are welded on upper L-shaped hinge plate 160 (FIG. 14). Truss cable 213 can hook on lower right truss ring 154 (FIG. 15). Upper-hinge pin 156 can be on either side of upper anti-warping anti-sagging interlocking-tube-nut hinge system 155 (FIGS. 16, 17, 18, 19, 20, and 21). The unique anti-warping anti-sagging interlocking gate can be used on posts of various cross-sectional shapes, such as square, rectangular, oval, round (FIGS. 20 and 21). For example, the unique anti-warping anti-sagging interlocking gate can be used on round-cross-section posts having upper left anti-warping anti-sagging triple-U-shaped-clamp bracket system 101 swinging in opposite directions of arrow 224 (FIG. 20).

Major Advantages of the Invention

Figure 4:
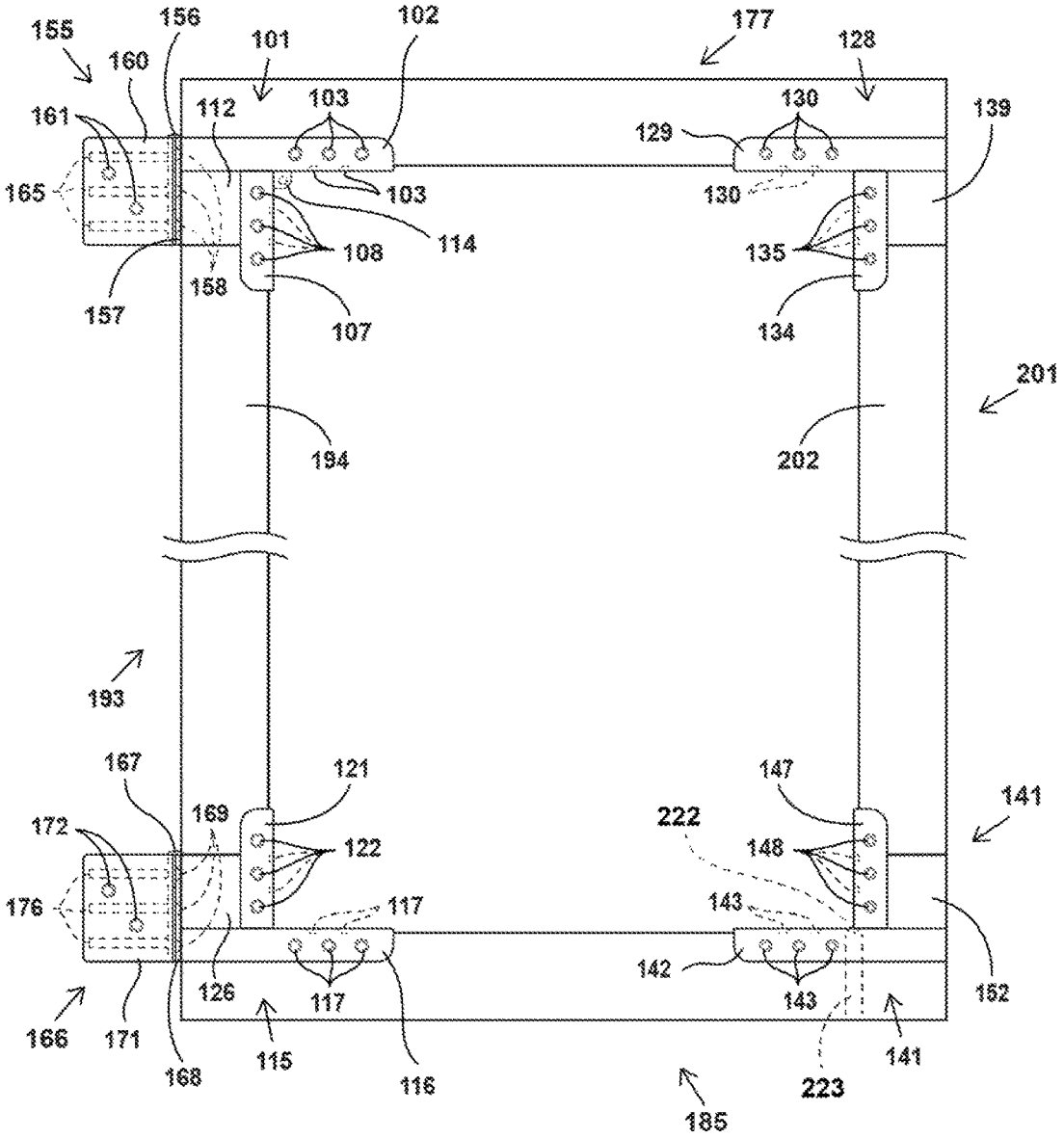
Figure 5:
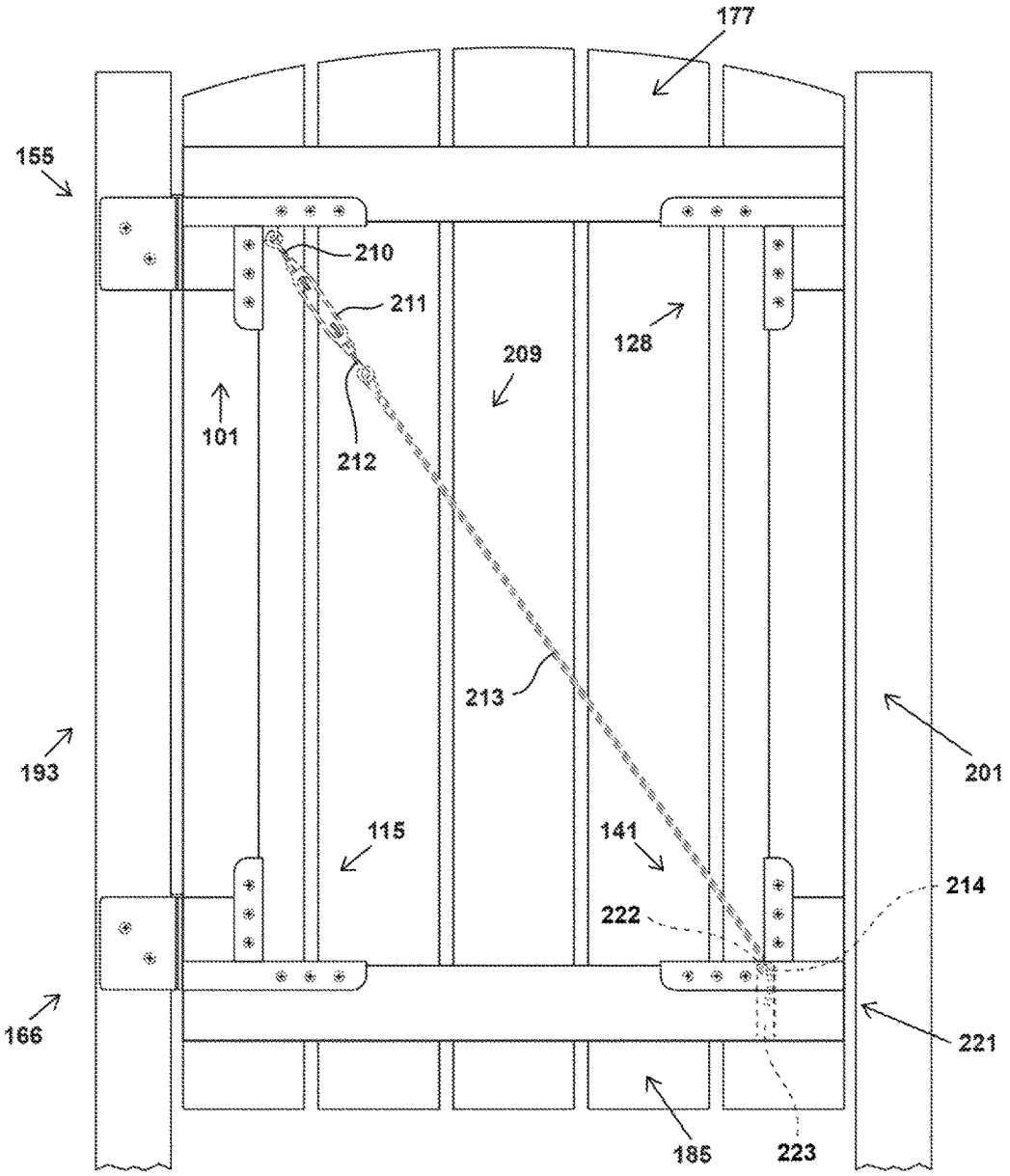
Figure 8A:
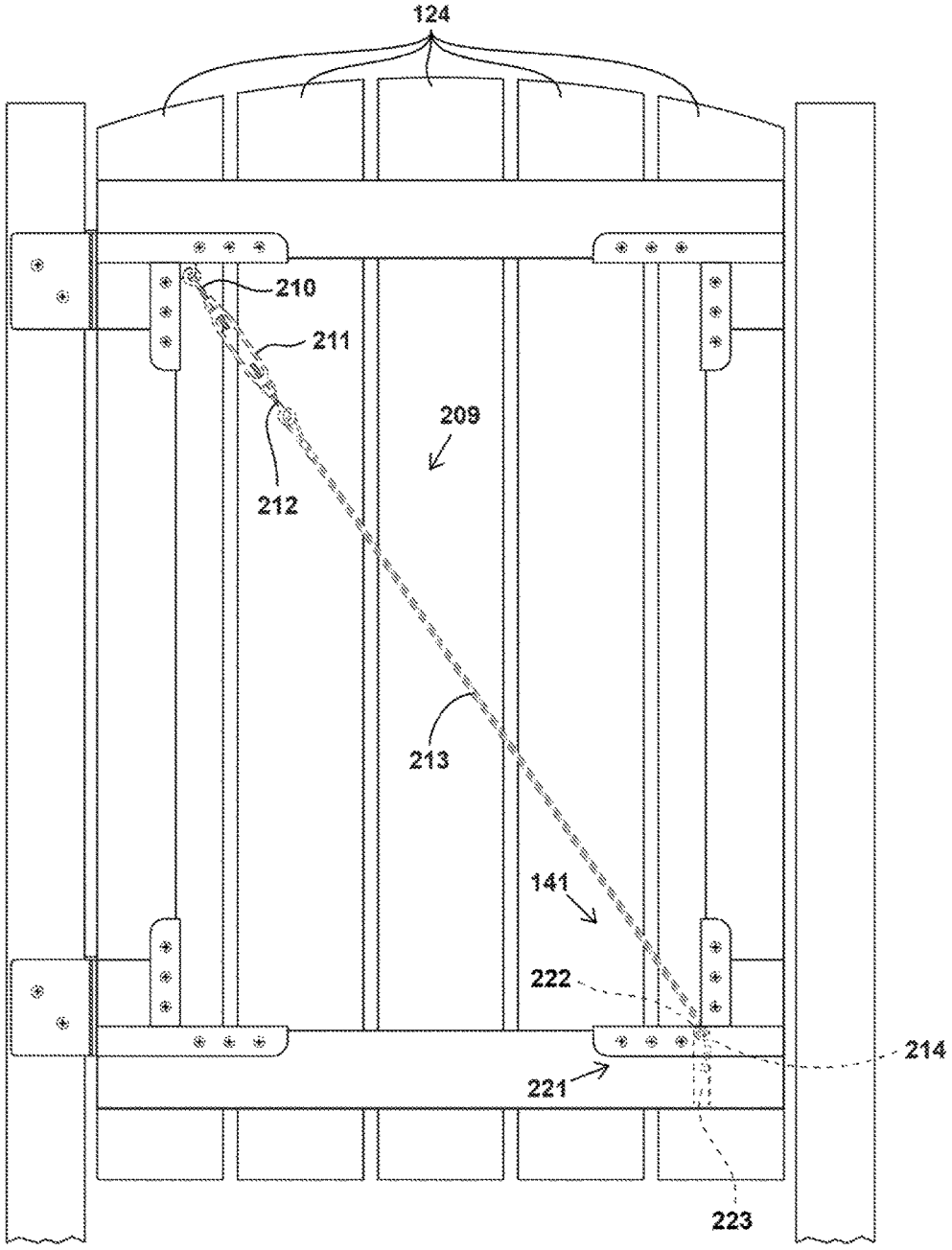
FIG. 8A illustrates a front view of the unique anti-warping anti-sagging interlocking gate.
Figure 8B:
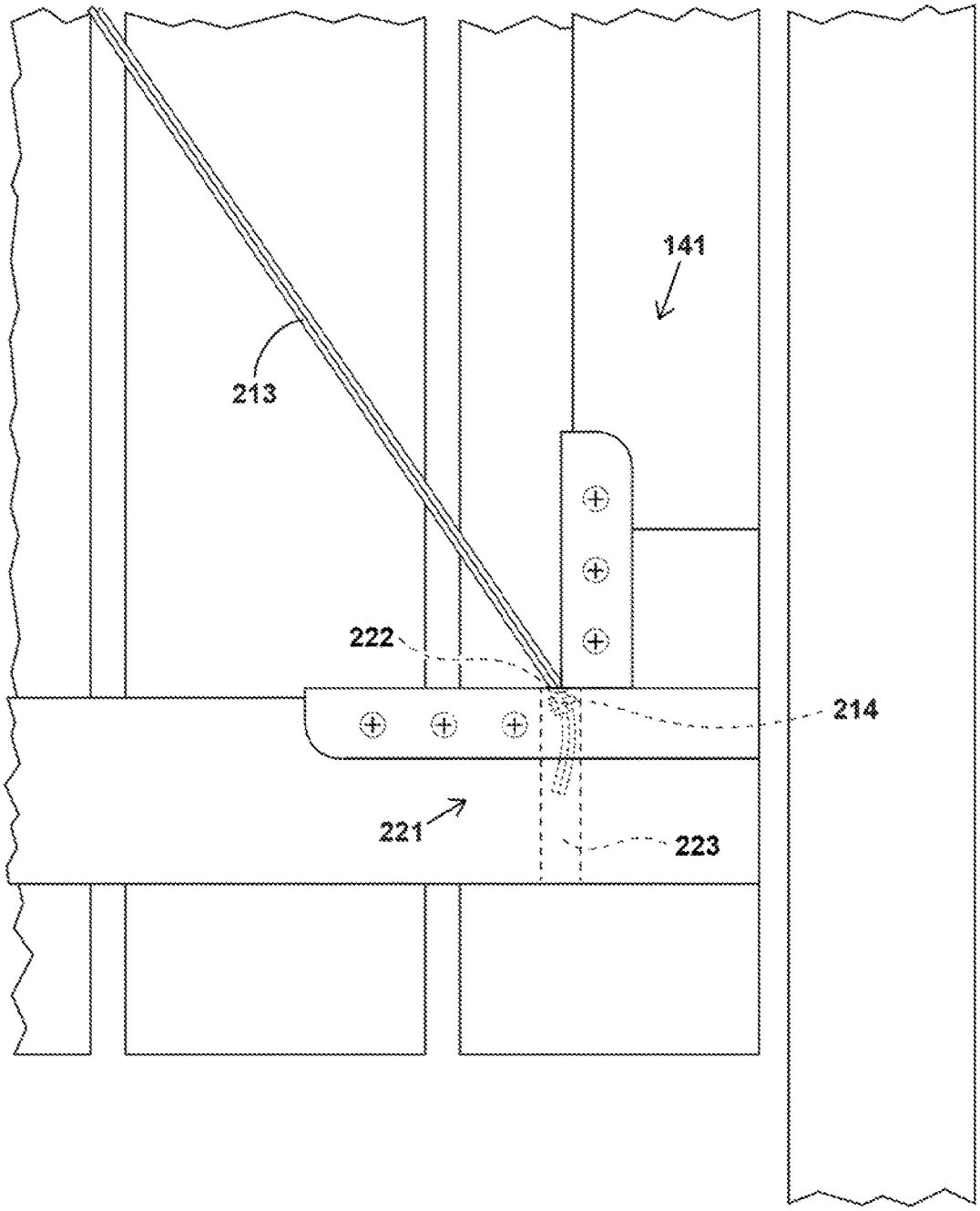
FIG. 8B illustrates an enlarged front view of the truss cable and the truss-cable-clamp tunnel system of the unique anti-warping anti-sagging interlocking gate.

The new invention substantially departs from the conventional concepts and designs of the prior art. In doing so, the new invention provides a unique anti-warping anti-sagging interlocking gate having many unique and significant features, functions, and advantages, which overcome all the disadvantages of the prior art, as follows:

1) It is an object of the new invention to provide a unique anti-warping anti-sagging interlocking gate, having
truss-cable-clamp tunnel 223 (FIGS. 8A and 8B).
Therefore, the unique anti-warping anti-sagging interlocking gate:
Can hide hazardous messy truss cable clamp 214 and the hazardous messy ends of truss cable 213 in truss-cable-clamp tunnel 223 (FIGS. 8A and 8B) to prevent them from poking and cutting the fingers and hands of people to eliminate personal injuries.
2) It is another object of the new invention to provide a unique anti-warping anti-sagging interlocking gate, having
truss-cable-clamp tunnel 223 (FIGS. 8A and 8B).
Therefore, the unique anti-warping anti-sagging interlocking gate:
Can hide hazardous messy truss cable clamp 214 and the hazardous messy ends of truss cable 213 in truss-cable-clamp tunnel 223 (FIGS. 8A and 8B) to protect them from weather elements to prevent them from rusting to prolong their service life span.
3) It is a further object of the new invention to provide a unique anti-warping anti-sagging interlocking gate, having
truss-cable-clamp tunnel 223 (FIGS. 8A and 8B).
Therefore, the unique anti-warping anti-sagging interlocking gate
Can hide hazardous messy truss cable clamp 214 and the hazardous messy ends of truss cable 213 in truss-cable-clamp tunnel 223 (FIGS. 8A and 8B) to make the unique anti-warping anti-sagging interlocking gate safer and to give the unique anti-warping anti-sagging interlocking gate a unique smooth, stylish, and modern look (free of hazardous messy truss cable clamp 214 and the hazardous messy ends of truss cable 213).
4) It is an even further object of the new invention to provide a unique anti-warping anti-sagging interlocking gate, having
upper left horizontal-U-shaped-clamp tube nuts 105,
upper left vertical-U-shaped-clamp tube nuts 110,
lower left horizontal-U-shaped-clamp tube nuts 119, and
lower left vertical-U-shaped-clamp tube nuts 124 (FIGS. 3 and 4).
Therefore, the unique anti-warping anti-sagging interlocking gate:
Can have metallic screws 106, 111. 120, and 125 screwed through wooden struts into metallic tube nuts 105, 110, 119, and 124 (not just into wooden struts) (FIGS. 3 and 4) to prevent the unique anti-warping anti-sagging interlocking gate from getting rotten, warping, and sagging to prolong its service life span.

5) It is another object of the new invention to provide a unique anti-warping anti-sagging interlocking gate, having
upper right horizontal-U-shaped-clamp tube nuts 132,
upper right vertical-U-shaped-clamp tube nuts 137,
lower right horizontal-U-shaped-clamp tube nuts 145, and
lower right vertical-U-shaped-clamp tube nuts 150 (FIGS. 3 and 4).
Therefore, the unique anti-warping anti-sagging interlocking gate:
Can have metallic screws 133, 138. 146, and 151 screwed through wooden struts into metallic tube nuts 132, 137, 145, and 150 (not just into wooden struts) (FIGS. 3 and 4) to prevent the unique anti-warping anti-sagging interlocking gate from warping and sagging to prolong its service life span.

Figure 6A:
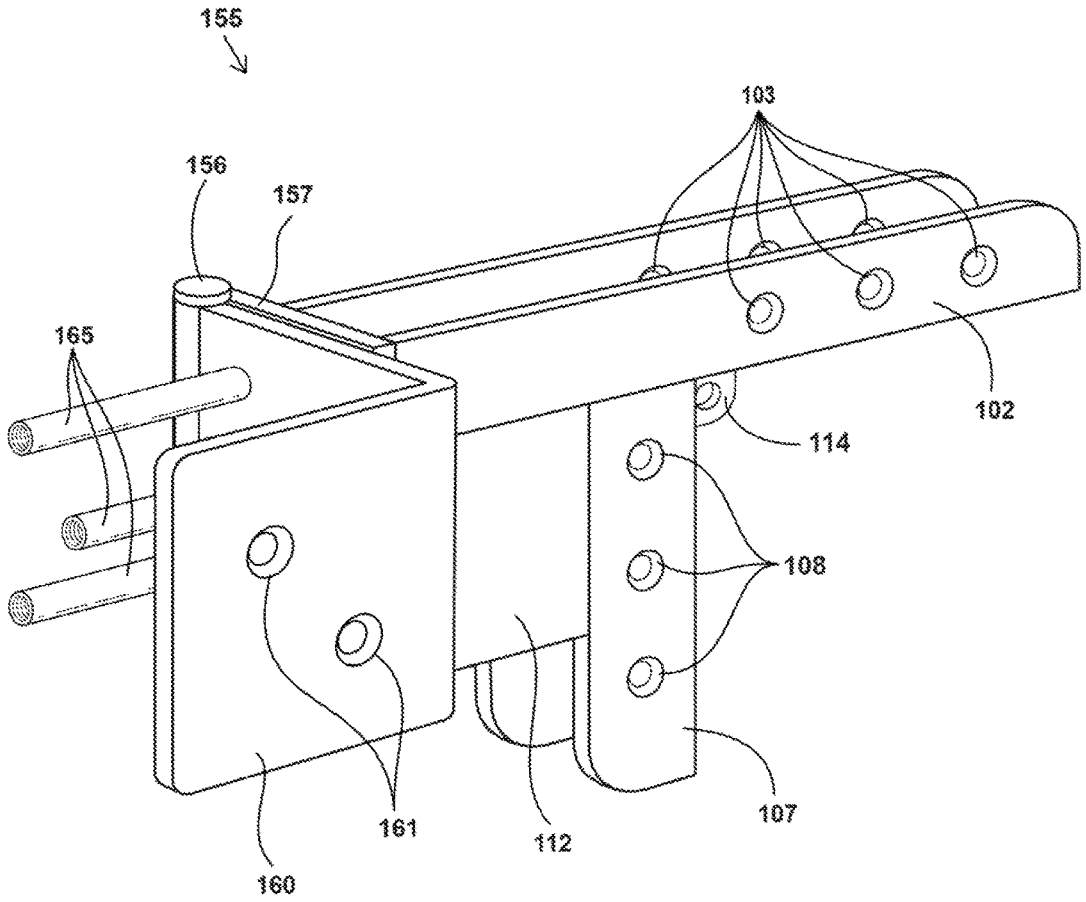
FIGS. 6A and 6B illustrate perspective views of an upper left anti-warping anti-sagging triple-U-shaped-clamp bracket system and an upper anti-warping anti-sagging interlocking-tube-nut hinge system.
Figure 6B:
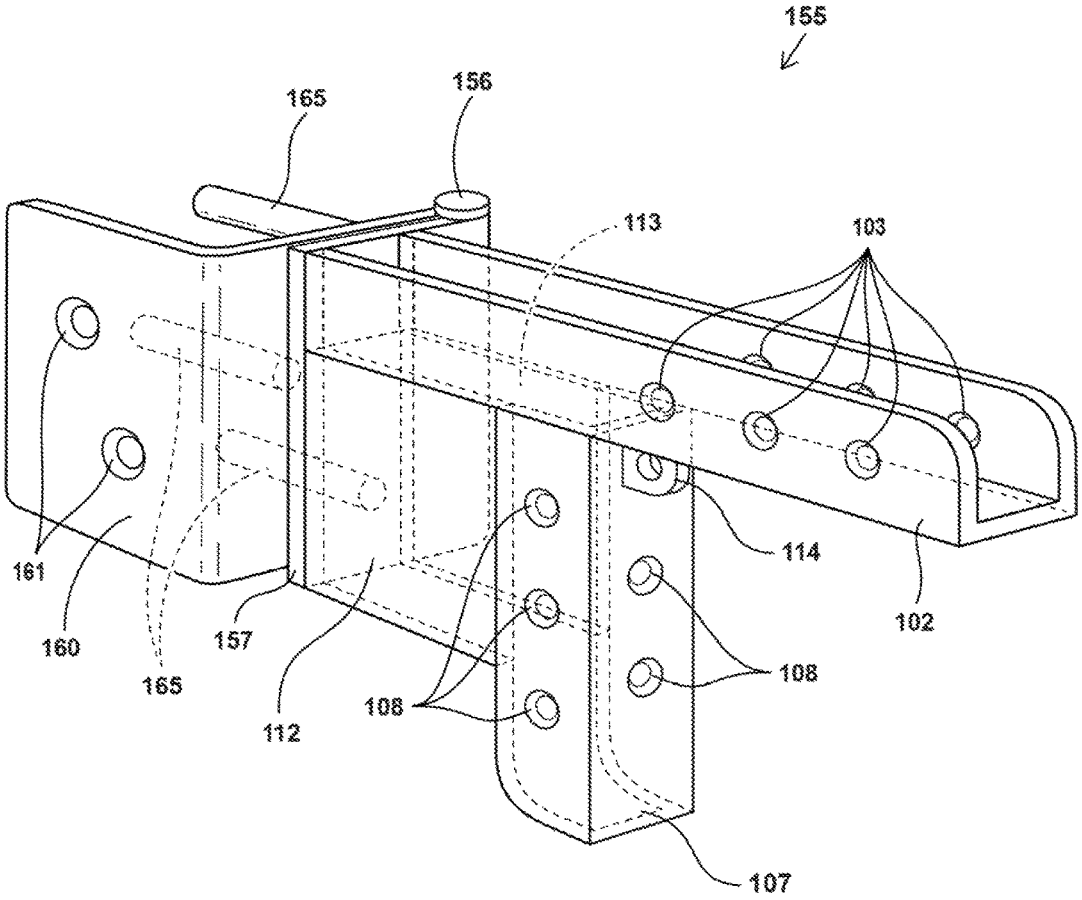
Figure 6C:
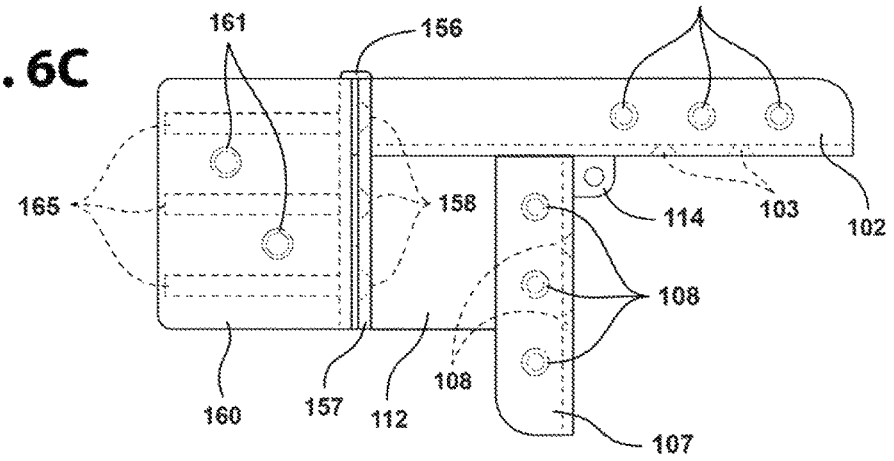
FIG. 6C illustrates a front view of the upper left anti-warping anti-sagging triple-U-shaped-clamp bracket system and the upper anti-warping anti-sagging interlocking-tube-nut hinge system.
Figure 6D:
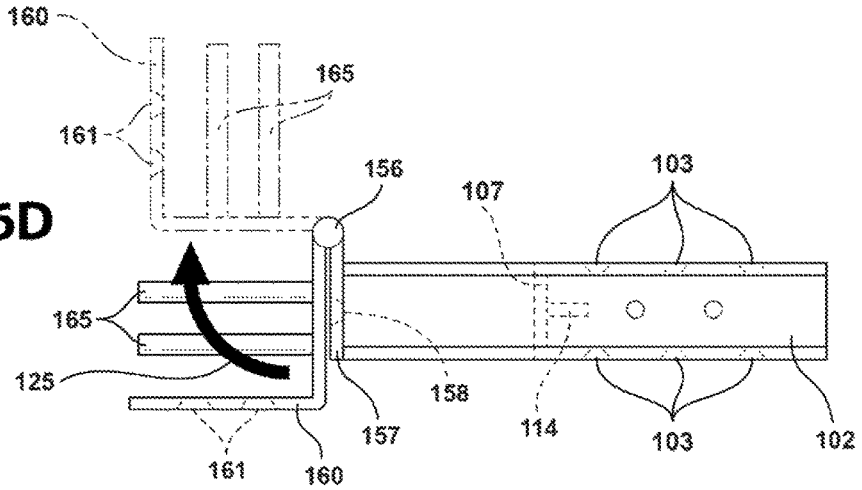
FIG. 6D illustrates a top view of the upper left anti-warping anti-sagging triple-U-shaped-clamp bracket system and the upper anti-warping anti-sagging interlocking-tube-nut hinge system (with the hinge rotating from a closed position to an open position).
Figure 6E:
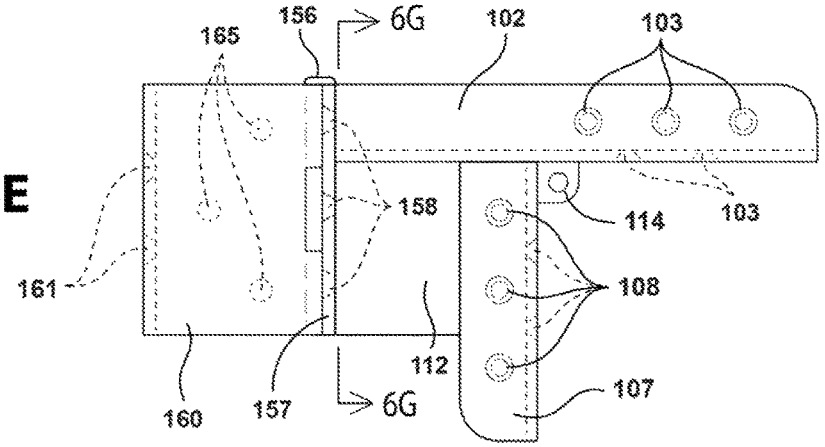
FIG. 6E illustrates a front view of the upper left anti-warping anti-sagging triple-U-shaped-clamp bracket system and the upper anti-warping anti-sagging interlocking-tube-nut hinge system (with the hinge in an open position).
Figure 6G:
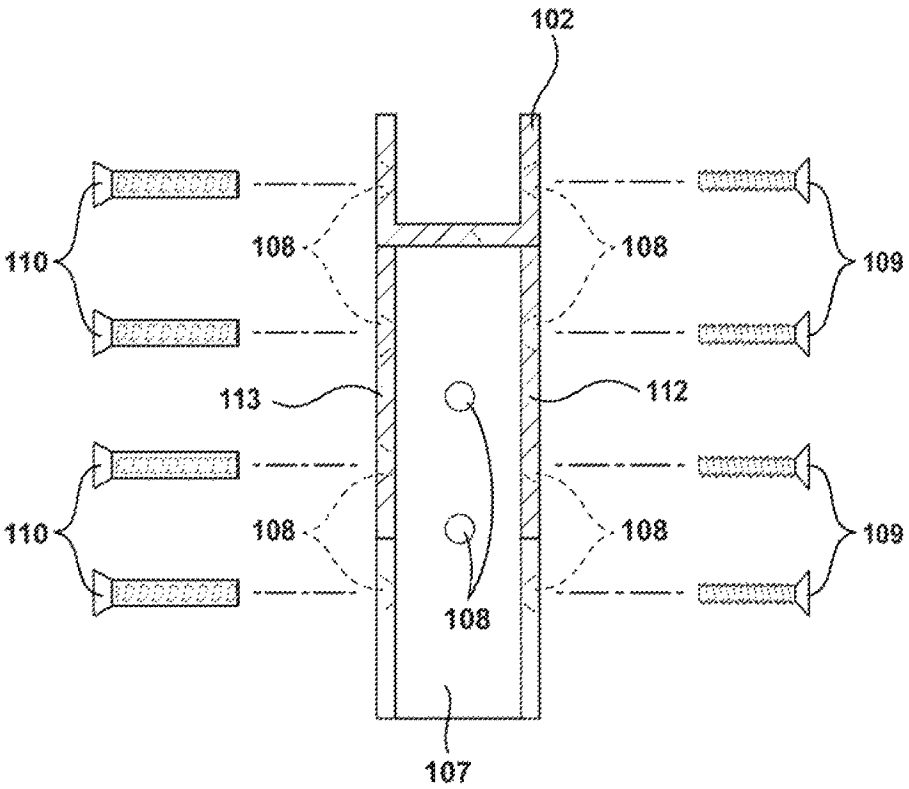
FIG. 6G illustrates a left-side sectional view of the upper left anti-warping anti-sagging triple-U-shaped-clamp bracket system.
Figure 6F:
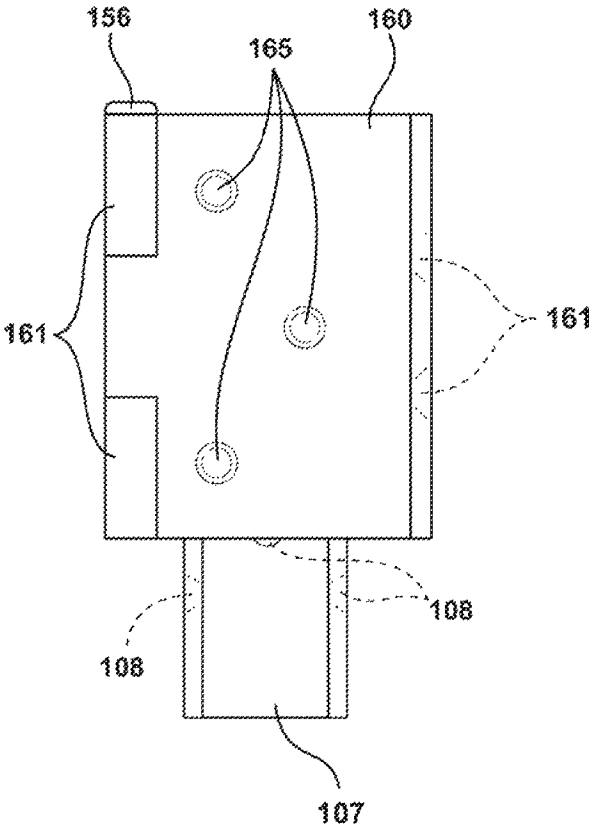
FIG. 6F illustrates a left-side view of the upper anti-warping anti-sagging interlocking-tube-nut hinge system.

6) It is yet another object of the new invention to provide a unique anti-warping anti-sagging interlocking gate, having
upper left middle-U-shaped-clamp front plate 112,
upper left middle-U-shaped-clamp rear plate 113,
lower left middle-U-shaped-clamp front plate 126, and
lower left middle-U-shaped-clamp rear plate 127 (FIGS. 6A and 6B).
Therefore, the unique anti-warping anti-sagging interlocking gate:
Can reinforce and strengthen itself to prevent the unique anti-warping anti-sagging interlocking gate from getting rotten, warping, and sagging to prolong its service life span.

7) It is still yet another object of the new invention to provide a unique anti-warping anti-sagging interlocking gate, having
upper right middle-U-shaped-clamp front plate 139,
upper right middle-U-shaped-clamp rear plate 140,
lower right middle-U-shaped-clamp front plate 152, and
lower right middle-U-shaped-clamp rear plate 153 (FIGS. 6A and 6B).
Therefore, the unique anti-warping anti-sagging interlocking gate:
Can reinforce and strengthen itself to prevent the unique anti-warping anti-sagging interlocking gate from getting rotten, warping, and sagging to prolong its service life span.

Figure 6H:
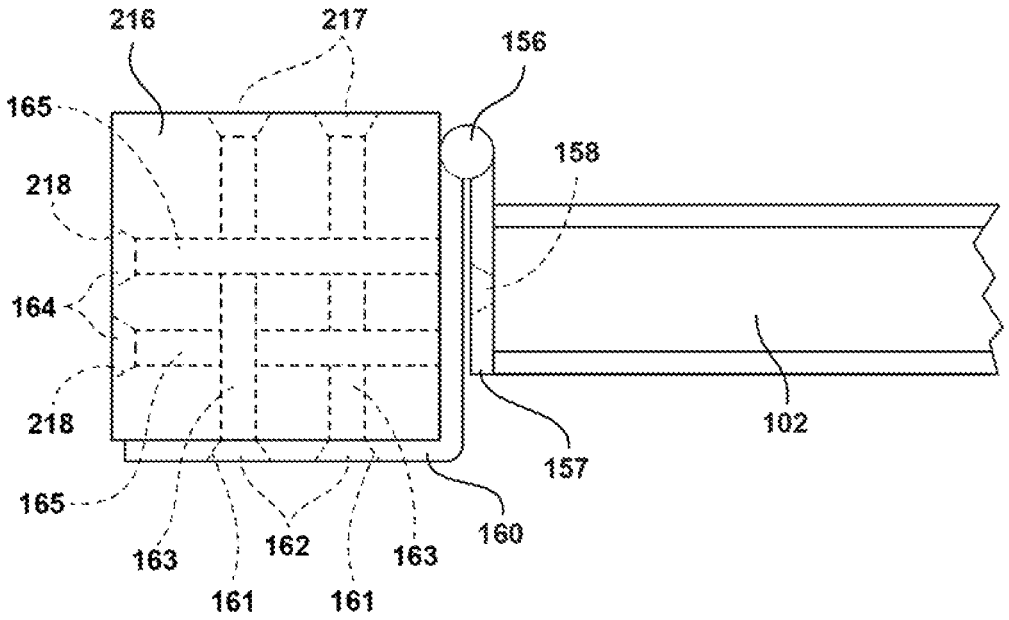
FIG. 6H illustrates a top view of how the upper anti-warping anti-sagging interlocking-tube-nut hinge system is attached to a post.
Figure 6I:
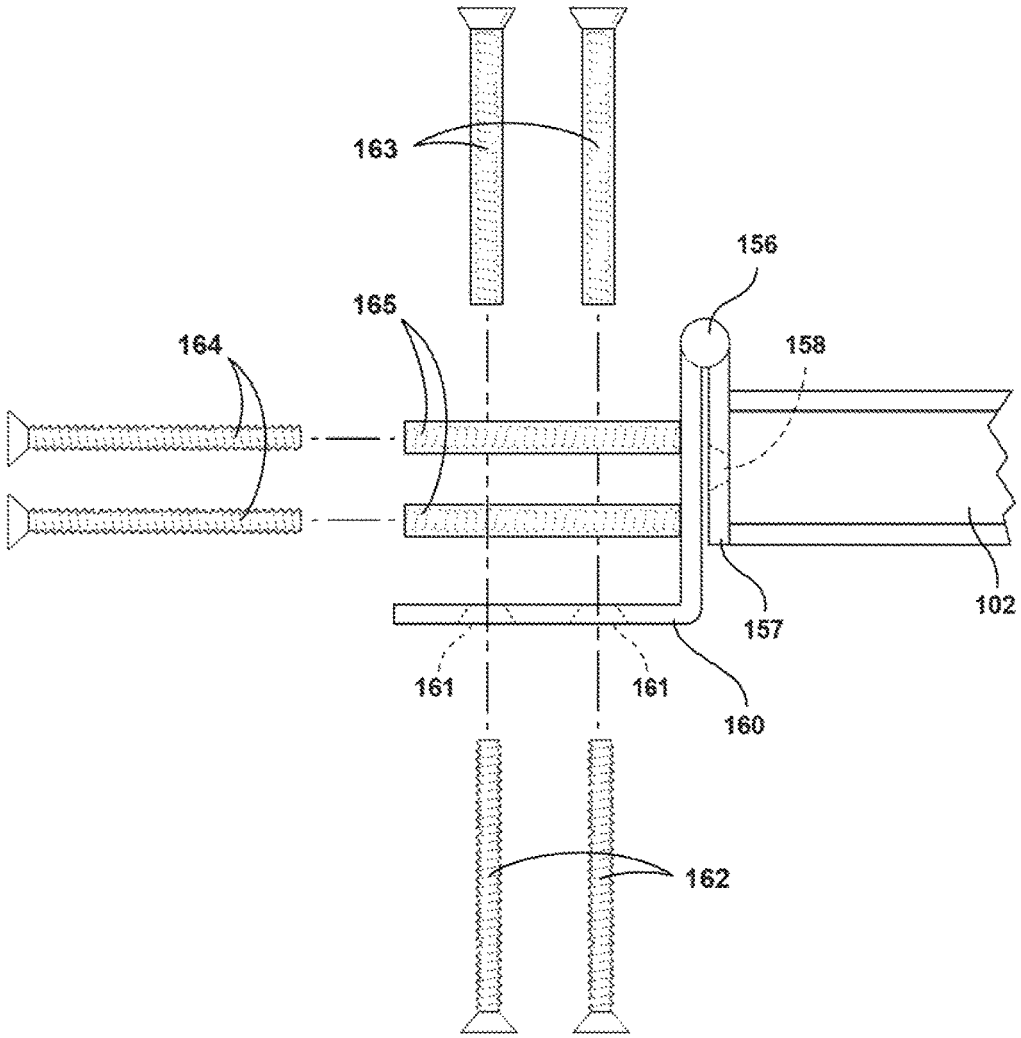
FIG. 6I illustrates a top exploded view of the upper anti-warping anti-sagging interlocking-tube-nut hinge system.
Figure 7A:
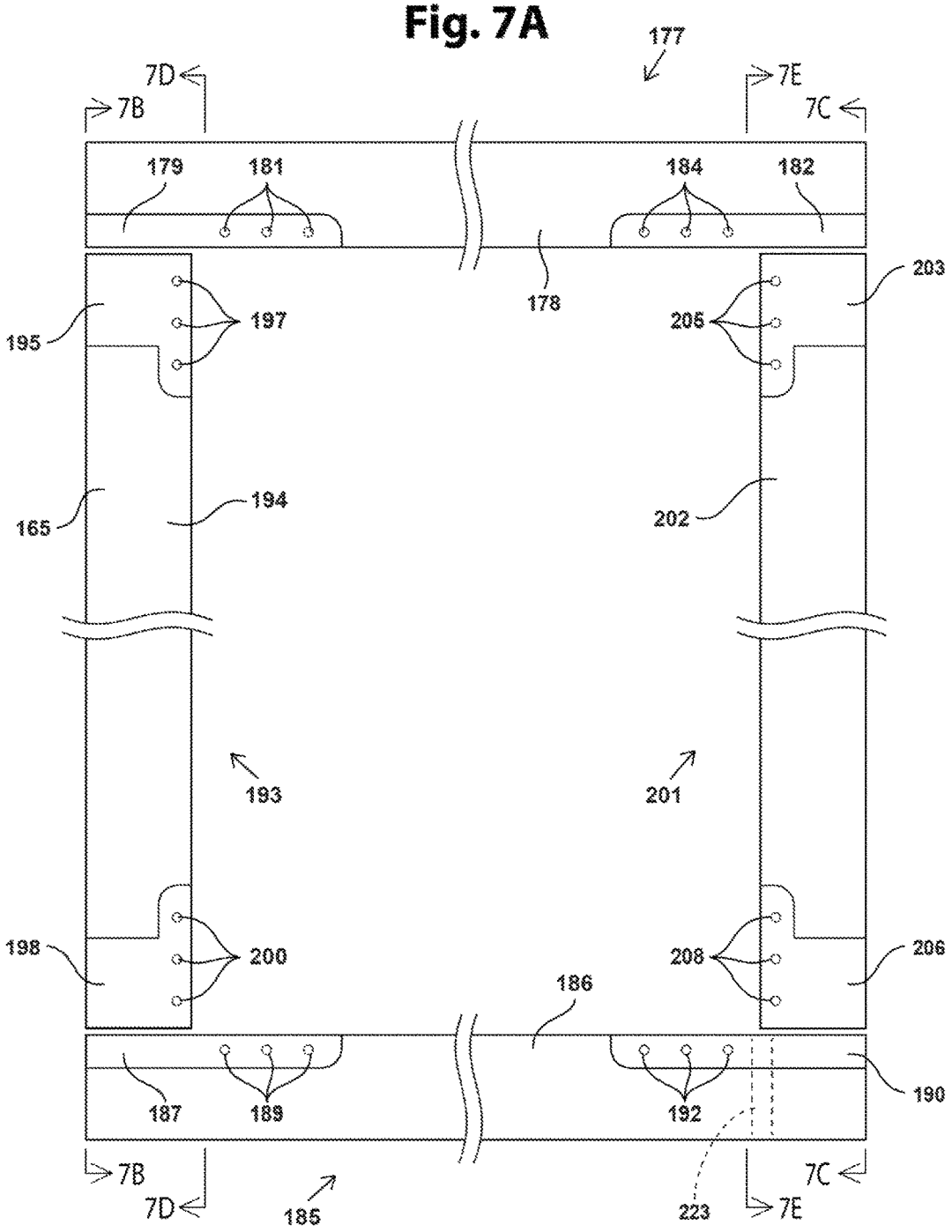
FIG. 7A illustrates a front view of an upper strut system, a lower strut system, a left strut system, and a right strut system.
Figure 7B:
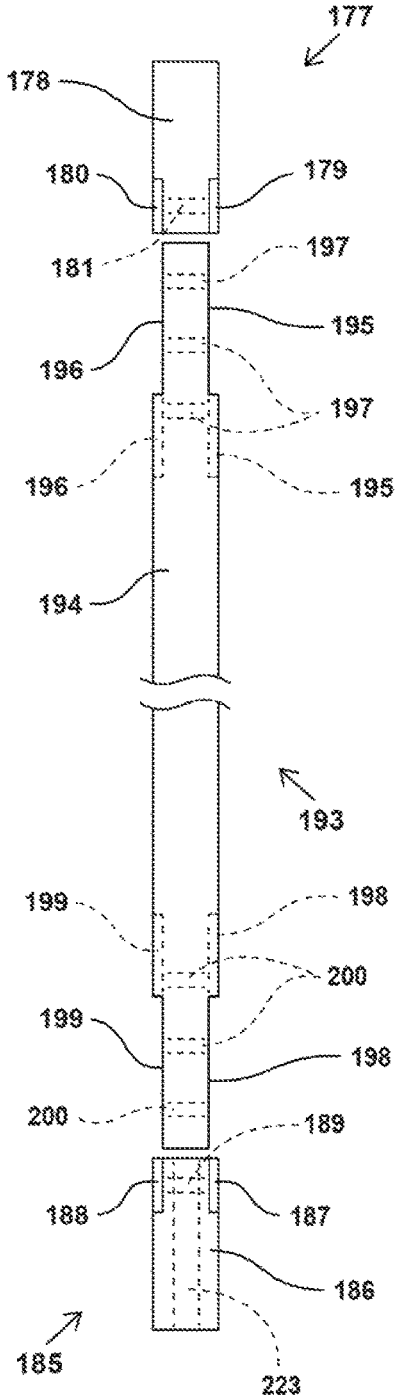
FIG. 7B illustrates a left-side view of the upper strut system, the lower strut system, and the left strut system.
Figure 7C:
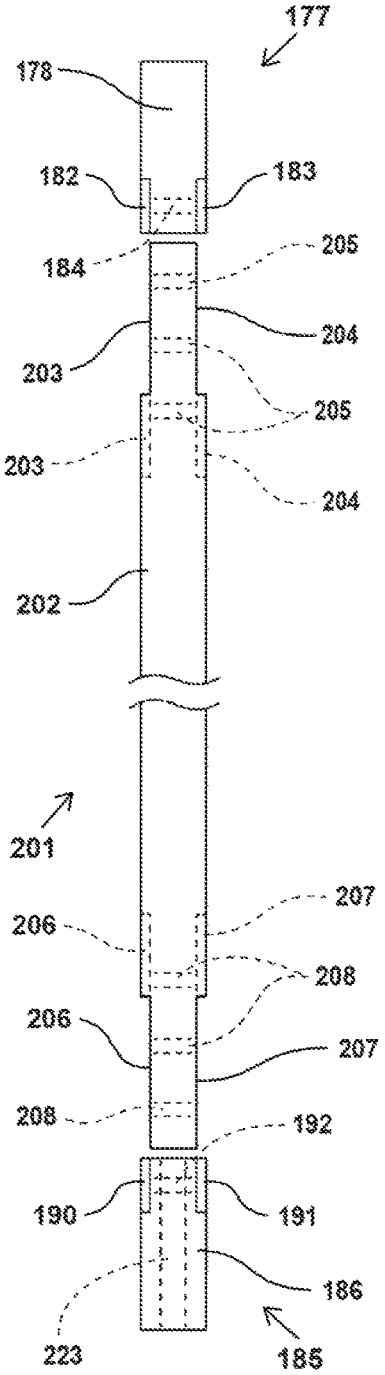
FIG. 7C illustrates a right-side view of the upper strut system, the lower strut system, and the right strut system.
Figure 7D:
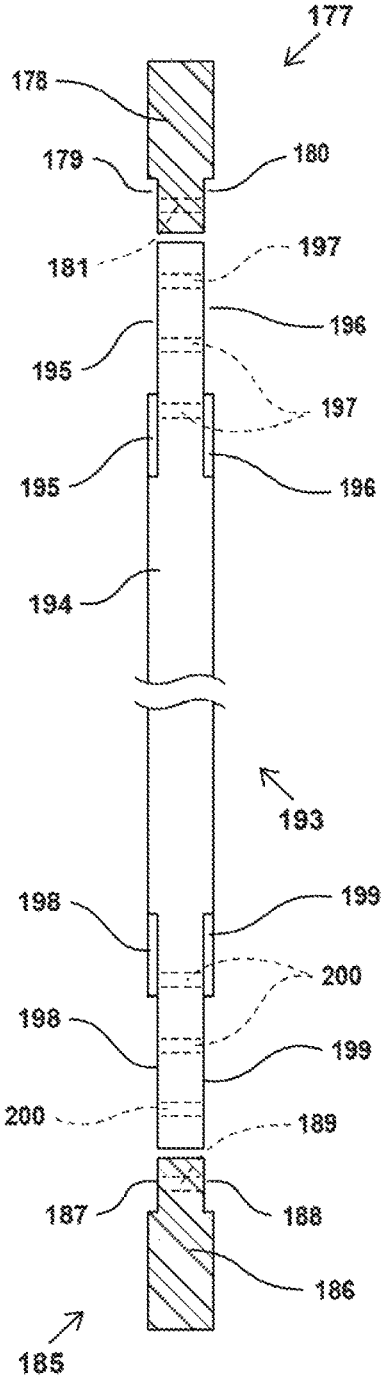
FIG. 7D illustrates a left-side sectional view of the upper strut system, the lower strut system, and the left strut system.
Figure 7E:
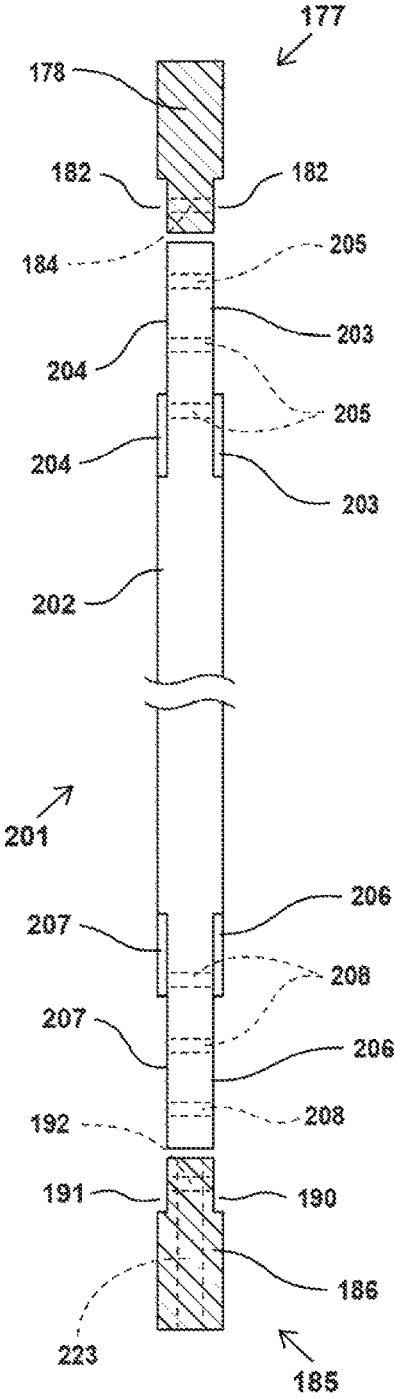
FIG. 7E illustrates a right-side sectional view of the upper strut system, the lower strut system, and the right strut system.

8) It is still yet an even further object of the new invention to provide a unique anti-warping anti-sagging interlocking gate, having
upper L-shaped-hinge-plate front tube nuts 163,
upper L-shaped-hinge-plate side tube nuts 165,
lower L-shaped-hinge-plate front tube nuts 174, and
lower L-shaped-hinge-plate side tube nuts 176 (FIGS. 6H and 6I).
Therefore, the unique anti-warping anti-sagging interlocking gate:
Can secure (in two 90-degree directions, which are side-to-side and front-to-rear directions) upper and lower anti-warping anti-sagging interlocking-tube-nut hinge systems 155 and 166 (FIGS. 6H and 6I) to prevent the unique anti-warping anti-sagging interlocking gate from getting rotten, warping, and sagging to prolong its service life span.

9) It is still yet an even further object of the new invention to provide a unique anti-warping anti-sagging interlocking gate, having
upper L-shaped-hinge-plate front tube nuts 163,
upper L-shaped-hinge-plate side tube nuts 165,
lower L-shaped-hinge-plate front tube nuts 174, and
lower L-shaped-hinge-plate side tube nuts 176 (FIGS. 6A and 6H).
Therefore, the unique anti-warping anti-sagging interlocking gate:
Can secure (in five crisscross different elevations, which are side-to-side and front-to-rear elevations) upper and lower anti-warping anti-sagging interlocking-tube-nut hinge systems 155 and 166 (FIGS. 6A and 6H) to prevent the unique anti-warping anti-sagging interlocking gate from getting rotten, warping, and sagging to prolong its service life span.

What is claimed is:

1. An anti-warping anti-sagging interlocking gate, for preventing personal injury, comprising:
a plurality of anti-warping anti-sagging bracket systems, each of said anti-warping anti-sagging bracket systems comprising:
a horizontal U-shaped clamp,
a plurality of horizontal U-shaped-clamp screw openings drilled in said horizontal U-shaped clamp,
a plurality of horizontal-U-shaped-clamp screws,
a plurality of horizontal-U-shaped-clamp tube nuts,
a vertical u-shaped clamp welded to said horizontal U-shaped clamp,
a plurality of vertical-U-shaped-clamp screw openings drilled in said vertical U-shaped clamp,
a plurality of vertical-U-shaped-clamp screws,
a plurality of vertical-U-shaped-clamp tube nuts,
a front plate welded to said horizontal u-shaped clamp and said vertical U-shaped clamp, and
a rear plate welded to said horizontal u-shaped clamp and said vertical U-shaped clamp;
a plurality of anti-warping anti-sagging interlocking-tube-nut hinge systems, each of said anti-warping anti-sagging interlocking-tube-nut hinge systems welded to one of said anti-warping anti-sagging bracket systems, each of said anti-warping anti-sagging interlocking-tube-nut hinge systems comprising:
a J-shaped hinge plate,
a plurality of J-shaped-hinge-plate screw openings drilled in said J-shaped hinge plate, an L-shaped-hinge-plate,
a plurality of J-shaped-hinge-plate screws,
a plurality of L-shaped-hinge-plate screw openings drilled in said L-shaped hinge plate,
a hinge pin, said hinge pin pivotably joining said j-shaped hinge plate and said L-shaped hinge plate together,
a plurality of L-shaped-hinge-plate front screws,
a plurality of L-shaped-hinge-plate front tube nuts,
a plurality of L-shaped-hinge-plate side screws, and
a plurality of L-shaped-hinge-plate side tube nuts;
a strut system, comprising:
a plurality of horizontal struts, and
a plurality of vertical struts, said vertical struts attached to said horizontal struts respectively to form said anti-warping anti-sagging interlocking gate;
a truss-cable-clamp-hiding tunnel system, said truss-cable-clamp-hiding tunnel system comprising:
a truss-cable-clamp-hiding opening drilled in one of said horizontal or vertical u-shaped clamps, and
a truss-cable-clamp-hiding tunnel drilled in one of said horizontal or vertical struts;
a truss system, said truss system comprising:
a ring hook attached to one of said horizontal or vertical struts, a turnbuckle screwed to said ring hook, a cable hook screwed to said turnbuckle, a truss cable hooked on said cable hook and threaded through said truss-cable-clamp-hiding opening into said truss-cable-clamp-hiding tunnel, said truss cable having a plurality of cable ends, and a truss cable clamp; and a gate post, wherein, said truss-cable-clamp-hiding tunnel is for hiding said cable ends inside one of said horizontal or vertical struts to prevent said cable ends from poking and cutting people to eliminate personal injuries, to protect said cable ends and said truss cable clamp from weather elements to prevent said cable ends and said truss cable clamp from rusting, and to make said anti-warping anti-sagging interlocking gate safer, said truss cable clamp is for clamping on said cable ends to secure said cable ends inside said truss-cable-clamp-hiding tunnel, said horizontal-U-shaped-clamp tube nuts are for screwing said horizontal-U-shaped-clamp screws therein through said horizontal struts respectively to prevent said anti-warping anti-sagging interlocking gate from warping and sagging, said vertical-U-shaped-clamp tube nuts are for screwing said vertical-U-shaped-clamp screws therein through said vertical struts respectively to prevent said anti-warping anti-sagging interlocking gate from warping and sagging, said L-shaped-hinge-plate front tube nuts are for screwing said L-shaped-hinge-plate front screws therein respectively in different directions than those of said L-shaped-hinge-plate side screws and in different elevations than those of said L-shaped-hinge-plate side screws to interlock said L-shaped-hinge-plate front tube nuts and said L-shaped-hinge-plate side tube nuts together to prevent said anti-warping anti-sagging interlocking gate from warping and sagging, and to interlock said L-shaped-hinge-plate front screws and said L-shaped-hinge-plate side screws together to prevent said anti-warping anti-sagging interlocking gate from warping and sagging, said L-shaped-hinge-plate side tube nuts are for screwing said L-shaped-hinge-plate side screws therein respectively in different directions than those of said L-shaped-hinge-plate front screws and in different elevations than those of said L-shaped-hinge-plate front screws to interlock said L-shaped-hinge-plate front tube nuts and said L-shaped-hinge-plate side tube nuts together to prevent said anti-warping anti-sagging interlocking gate from warping and sagging, and to interlock said L-shaped-hinge-plate front screws and said L-shaped-hinge-plate side screws together to prevent said anti-warping anti-sagging interlocking gate from warping and sagging.

2. The anti-warping anti-sagging interlocking gate of claim 1, further, comprising a plurality of pointed-tip screws and additional horizontal U-shaped-clamp screw openings drilled in said horizontal U-shaped clamp, wherein said pointed-tip screws are for screwing through said additional horizontal U-shaped-clamp screw openings into said horizontal struts.

3. The anti-warping anti-sagging interlocking gate of claim 1, further, comprising a plurality of pointed-tip screws and additional vertical U-shaped-clamp screw openings drilled in said vertical U-shaped clamp, wherein said pointed-tip screws are for screwing through said additional vertical U-shaped-clamp screw openings into said vertical struts.

4. The anti-warping anti-sagging interlocking gate of claim 1, further, comprising a plurality of tunnels drilled in said horizontal struts and said vertical struts for said horizontal-U-shaped-clamp tube nuts and said vertical-U-shaped-clamp tube nuts to be inserted into, respectively.

5. The anti-warping anti-sagging interlocking gate of claim 1, further, comprising a plurality of recesses cut into said horizontal struts and said vertical struts for said horizontal u-shaped clamps and said vertical u-shaped clamps to be inserted into, respectively.

6. The anti-warping anti-sagging interlocking gate of claim 1, wherein, said L-shaped-hinge-plate front tube nuts are welded to said L-shaped-hinge-plate.

7. The anti-warping anti-sagging interlocking gate of claim 1, wherein, said L-shaped-hinge-plate side tube nuts are welded to said L-shaped-hinge-plate.

8. The anti-warping anti-sagging interlocking gate of claim 1, wherein, said gate post has a cross-section selected from the group consisting of: a square cross-section, a round cross-section, and a rectangular cross-section.

9. An anti-warping anti-sagging interlocking gate comprising:

a plurality of anti-warping anti-sagging bracket systems, each of said anti-warping anti-sagging bracket systems comprising:

a horizontal U-shaped clamp, a plurality of horizontal U-shaped-clamp screw openings drilled in said horizontal U-shaped clamp, a plurality of horizontal-U-shaped-clamp screws, a plurality of horizontal-U-shaped-clamp tube nuts, a vertical u-shaped clamp welded to said horizontal U-shaped clamp, a plurality of vertical-U-shaped-clamp screw openings drilled in said vertical U-shaped clamp, a plurality of vertical-U-shaped-clamp screws, a plurality of vertical-U-shaped-clamp tube nuts, a front plate welded to said horizontal u-shaped clamp and said vertical U-shaped clamp, and a rear plate welded to said horizontal u-shaped clamp and said vertical U-shaped clamp;

a plurality of anti-warping anti-sagging interlocking-tube-nut hinge systems, each of said anti-warping anti-sagging interlocking-tube-nut hinge systems welded to one of said anti-warping anti-sagging bracket systems, each of said anti-warping anti-sagging interlocking-tube-nut hinge systems comprising:

a J-shaped hinge plate, a plurality of L-shaped-hinge-plate screw openings drilled in said L-shaped hinge plate, a hinge pin, said hinge pin pivotably joining said j-shaped hinge plate and said L-shaped hinge plate together, a plurality of L-shaped-hinge-plate front screws, a plurality of L-shaped-hinge-plate front tube nuts, a plurality of L-shaped-hinge-plate side screws, and a plurality of L-shaped-hinge-plate side tube nuts;

a strut system, comprising:

a plurality of horizontal struts, and a plurality of vertical struts, said vertical struts attached to said horizontal struts respectively to form said anti-warping anti-sagging interlocking gate;

a truss-cable-clamp-hiding tunnel system, said truss-cable-clamp-hiding tunnel system comprising:

a truss-cable-clamp-hiding opening drilled in one of said horizontal or vertical u-shaped clamps, and a truss-cable-clamp-hiding tunnel drilled in one of said horizontal or vertical struts;

a truss system, said truss system comprising:

a ring hook attached to one of said horizontal or vertical struts, a turnbuckle screwed to said ring hook, a cable hook screwed to said turnbuckle, a truss cable hooked on said cable hook and threaded through said truss-cable-clamp-hiding opening into said truss-cable-clamp-hiding tunnel, said truss cable having a plurality of cable ends, and a truss cable clamp; and a gate post, wherein, said truss-cable-clamp-hiding tunnel is for hiding said cable ends inside one of said horizontal or vertical struts to prevent said cable ends from poking and cutting people to eliminate personal injuries, to protect said cable ends and said truss cable clamp from weather elements to prevent said cable ends and said truss cable clamp from rusting, and to make said anti-warping anti-sagging interlocking gate safer, said truss cable clamp is for clamping on said cable ends to secure said cable ends inside said truss-cable-clamp-hiding tunnel, said horizontal-U-shaped-clamp tube nuts are for screwing said horizontal-U-shaped-clamp screws therein through said horizontal struts respectively to prevent said anti-warping anti-sagging interlocking gate from warping and sagging, said vertical-U-shaped-clamp tube nuts are for screwing said vertical-U-shaped-clamp screws therein through said vertical struts respectively to prevent said anti-warping anti-sagging interlocking gate from warping and sagging, said L-shaped-hinge-plate front tube nuts are for screwing said L-shaped-hinge-plate front screws therein respectively in different directions than those of said L-shaped-hinge-plate side screws and in different elevations than those of said L-shaped-hinge-plate side screws to interlock said L-shaped-hinge-plate front tube nuts and said L-shaped-hinge-plate side tube nuts together to prevent said anti-warping anti-sagging interlocking gate from warping and sagging, and to interlock said L-shaped-hinge-plate front screws and said L-shaped-hinge-plate side screws together to prevent said anti-warping anti-sagging interlocking gate from warping and sagging, said L-shaped-hinge-plate side tube nuts are for screwing said L-shaped-hinge-plate side screws therein respectively in different directions than those of said L-shaped-hinge-plate front screws and in different elevations than those of said L-shaped-hinge-plate front screws to interlock said L-shaped-hinge-plate front tube nuts and said L-shaped-hinge-plate side tube nuts together to prevent said anti-warping anti-sagging interlocking gate from warping and sagging, and to interlock said L-shaped-hinge-plate front screws and said L-shaped-hinge-plate side screws together to prevent said anti-warping anti-sagging interlocking gate from warping and sagging.

10. The anti-warping anti-sagging interlocking gate of claim 9, further, comprising a plurality of pointed-tip screws and additional horizontal U-shaped-clamp screw openings drilled in said horizontal U-shaped clamp, wherein said pointed-tip screws are for screwing through said additional horizontal U-shaped-clamp screw openings into said horizontal struts.

11. The anti-warping anti-sagging interlocking gate of claim 9, further, comprising a plurality of pointed-tip screws and additional vertical U-shaped-clamp screw openings drilled in said vertical U-shaped clamp, wherein said pointed-tip screws are for screwing through said additional vertical U-shaped-clamp screw openings into said vertical struts.

12. The anti-warping anti-sagging interlocking gate of claim 9, further, comprising a plurality of tunnels drilled in said horizontal struts and said vertical struts for said horizontal-U-shaped-clamp tube nuts and said vertical-U-shaped-clamp tube nuts to be inserted into, respectively.

13. The anti-warping anti-sagging interlocking gate of claim 9, further, comprising a plurality of recesses cut into said horizontal struts and said vertical struts for said horizontal u-shaped clamps and said vertical u-shaped clamps to be inserted into, respectively.

14. The anti-warping anti-sagging interlocking gate of claim 9, wherein, said L-shaped-hinge-plate front tube nuts are welded to said L-shaped-hinge-plate.

15. The anti-warping anti-sagging interlocking gate of claim 9, wherein, said L-shaped-hinge-plate side tube nuts are welded to said L-shaped-hinge-plate.

16. An anti-warping anti-sagging gate comprising:

a plurality of anti-warping anti-sagging bracket systems, each of said anti-warping anti-sagging bracket systems comprising:

a horizontal U-shaped clamp, a plurality of horizontal U-shaped-clamp screw openings drilled in said horizontal U-shaped clamp, a plurality of horizontal-U-shaped-clamp screws, a plurality of horizontal-U-shaped-clamp nuts, a vertical u-shaped clamp welded to said horizontal U-shaped clamp, a plurality of vertical-U-shaped-clamp screw openings drilled in said vertical U-shaped clamp, a plurality of vertical-U-shaped-clamp screws, a plurality of vertical-U-shaped-clamp nuts, a front plate welded to said horizontal u-shaped clamp and said vertical U-shaped clamp, and a rear plate welded to said horizontal u-shaped clamp and said vertical U-shaped clamp;

a plurality of anti-warping anti-sagging interlocking-tube-nut hinge systems, each of said anti-warping anti-sagging interlocking-tube-nut hinge systems welded to one of said anti-warping anti-sagging bracket systems, each of said anti-warping anti-sagging interlocking-tube-nut hinge systems comprising:

a J-shaped hinge plate, a plurality of L-shaped-hinge-plate screw openings drilled in said L-shaped hinge plate, a hinge pin, said hinge pin pivotably joining said j-shaped hinge plate and said L-shaped hinge plate together, a plurality of L-shaped-hinge-plate front screws, a plurality of L-shaped-hinge-plate front tube nuts, a plurality of L-shaped-hinge-plate side screws, and a plurality of L-shaped-hinge-plate side tube nuts;

a strut system, comprising:

a plurality of horizontal struts, and a plurality of vertical struts, said vertical struts attached to said horizontal struts respectively to form said anti-warping anti-sagging interlocking gate;

a truss-cable-clamp-hiding tunnel system, said truss-cable-clamp-hiding tunnel system comprising:

a truss-cable-clamp-hiding opening drilled in one of said horizontal or vertical u-shaped clamps, and a truss-cable-clamp-hiding tunnel drilled in one of said horizontal or vertical struts;

a truss system, said truss system comprising:

a ring hook attached to one of said horizontal or vertical struts, a turnbuckle screwed to said ring hook, a cable hook screwed to said turnbuckle, a truss cable hooked on said cable hook and threaded through said truss-cable-clamp-hiding opening into said truss-cable-clamp-hiding tunnel, said truss cable having a plurality of cable ends, and a truss cable clamp; and a gate post, wherein, said truss-cable-clamp-hiding tunnel is for hiding said cable ends inside one of said horizontal or vertical struts to prevent said cable ends from poking and cutting people to eliminate personal injuries, to protect said cable ends and said truss cable clamp from weather elements to prevent said cable ends and said truss cable clamp from rusting, and to make said anti-warping anti-sagging interlocking gate safer, said truss cable clamp is for clamping on said cable ends to secure said cable ends inside said truss-cable-clamp-hiding tunnel, said horizontal-U-shaped-clamp nuts are for screwing said horizontal-U-shaped-clamp screws therein through said horizontal struts respectively to prevent said anti-warping anti-sagging interlocking gate from warping and sagging, said vertical-U-shaped-clamp nuts are for screwing said vertical-U-shaped-clamp screws therein through said vertical struts respectively to prevent said anti-warping anti-sagging interlocking gate from warping and sagging, said L-shaped-hinge-plate front tube nuts are for screwing said L-shaped-hinge-plate front screws therein respectively in different directions than those of said L-shaped-hinge-plate side screws and in different elevations than those of said L-shaped-hinge-plate side screws to interlock said L-shaped-hinge-plate front tube nuts and said L-shaped-hinge-plate side tube nuts together to prevent said anti-warping anti-sagging interlocking gate from warping and sagging, and to interlock said L-shaped-hinge-plate front screws and said L-shaped-hinge-plate side screws together to prevent said anti-warping anti-sagging interlocking gate from warping and sagging, said L-shaped-hinge-plate side tube nuts are for screwing said L-shaped-hinge-plate side screws therein respectively in different directions than those of said L-shaped-hinge-plate front screws and in different elevations than those of said L-shaped-hinge-plate front screws to interlock said L-shaped-hinge-plate front tube nuts and said L-shaped-hinge-plate side tube nuts together to prevent said anti-warping anti-sagging interlocking gate from warping and sagging, and to interlock said L-shaped-hinge-plate front screws and said L-shaped-hinge-plate side screws together to prevent said anti-warping anti-sagging interlocking gate from warping and sagging.

17. The anti-warping anti-sagging interlocking gate of claim 16, further, comprising a plurality of pointed-tip screws and additional horizontal U-shaped-clamp screw openings drilled in said horizontal U-shaped clamp, wherein said pointed-tip screws are for screwing through said additional horizontal U-shaped-clamp screw openings into said horizontal struts.

18. The anti-warping anti-sagging interlocking gate of claim 16, further, comprising a plurality of pointed-tip screws and additional vertical U-shaped-clamp screw openings drilled in said vertical U-shaped clamp, wherein said pointed-tip screws are for screwing through said additional vertical U-shaped-clamp screw openings into said vertical struts.

19. The anti-warping anti-sagging interlocking gate of claim 16, wherein, said L-shaped-hinge-plate front tube nuts or said L-shaped-hinge-plate side tube nuts are welded to said L-shaped-hinge-plate.

20. The anti-warping anti-sagging interlocking gate of claim 16, further, comprising a plurality of recesses cut into said horizontal struts and said vertical struts for said horizontal u-shaped clamps and said vertical u-shaped clamps to be inserted into, respectively.

* * * * *